US011441080B2

(12) United States Patent
Dougherty et al.

(10) Patent No.: US 11,441,080 B2
(45) Date of Patent: Sep. 13, 2022

(54) LUBRICANT BASE STOCK PRODUCTION FROM RECYCLED OIL

(71) Applicant: ExxonMobil Technology and Engineering Company, Annandale, NJ (US)

(72) Inventors: Richard C. Dougherty, Moorestown, NJ (US); Kristin L. Sanfilippo, Garnet Valley, PA (US); Christine A. Zielinski, Garnet Valley, PA (US); Charles L. Baker, Jr., Thornton, PA (US)

(73) Assignee: EXXONMOBIL TECHNOLOGY AND ENGINEERING COMPANY, Annandale, NJ (US)

( * ) Notice: Subject to any disclaimer, the term of this patent is extended or adjusted under 35 U.S.C. 154(b) by 65 days.

(21) Appl. No.: 16/742,317

(22) Filed: Jan. 14, 2020

(65) Prior Publication Data

US 2020/0263107 A1 Aug. 20, 2020

Related U.S. Application Data

(60) Provisional application No. 62/805,600, filed on Feb. 14, 2019.

(51) Int. Cl.
*C10G 9/32* (2006.01)
*C10B 55/10* (2006.01)
(Continued)

(52) U.S. Cl.
CPC ..... *C10G 9/32* (2013.01); *C10B 55/10* (2013.01); *C10B 57/16* (2013.01); *C10G 2300/1007* (2013.01); *C10G 2300/203* (2013.01); *C10G 2300/302* (2013.01); *C10G 2400/10* (2013.01); *C10M 2203/1006* (2013.01); *C10N 2070/00* (2013.01)

(58) Field of Classification Search
CPC ..... C10G 9/005; C10G 9/32; C10B 55/10
See application file for complete search history.

(56) References Cited

U.S. PATENT DOCUMENTS 3,085,061 A 4/1963 Metrailer
3,684,689 A 8/1972 Patton et al.
(Continued)

FOREIGN PATENT DOCUMENTS

EP 0308195 A2 3/1989
WO 199212220 A1 7/1992
WO 2014205178 A1 12/2014

OTHER PUBLICATIONS

Seider, Sebastion K. et al., "FLEXICOKING(TM) Technology Resid Conversion Solution for Refinery Energy Optimization as Demonstrated in the Hellenic Petroleum Elefsina Upgrade Project", pp. 1-11, Jan. 2018 (Year: 2018).*
(Continued)

*Primary Examiner* — Renee Robinson
(74) *Attorney, Agent, or Firm* — Scott F. Yarnell

(57) ABSTRACT

Systems and methods are provided for co-processing of used lubricant oils with a coker feedstock in a fluidized coking process to form lubricant base stocks. The fluidized coking process can remove contaminants and/or additives from used lubricant oils with modest conversion of the lubricant boiling range portion.

21 Claims, 4 Drawing Sheets

(51) Int. Cl.
*C10B 57/16* (2006.01)
*C10N 70/00* (2006.01)

(56) References Cited

U.S. PATENT DOCUMENTS

| | | | | |
|---|---|---|---|---|
| 4,569,752 | A | 2/1986 | Aldridge et al. | |
| 5,143,597 | A * | 9/1992 | Sparks | C10G 9/005 208/131 |
| 5,248,410 | A * | 9/1993 | Clausen | C10B 55/00 208/125 |
| 5,472,596 | A | 12/1995 | Kerby et al. | |
| 8,366,912 | B1 | 2/2013 | MacDonald | |
| 9,574,145 | B1 | 2/2017 | McKnight et al. | |
| 9,677,013 | B2 | 6/2017 | MacDonald | |
| 9,914,887 | B2 | 3/2018 | Bhattacharya | |
| 2002/0179493 | A1 | 12/2002 | Etter | |
| 2016/0298048 | A1 | 10/2016 | Brown et al. | |
| 2016/0312126 | A1 * | 10/2016 | Wormsbecker | C10B 55/10 |

OTHER PUBLICATIONS

The International Search Report and Written Opinion of PCT/US2020/013480 dated Mar. 16, 2020.

* cited by examiner

LUBRICANT BASE STOCK PRODUCTION FROM RECYCLED OIL

CROSS-REFERENCE TO RELATED APPLICATIONS

This application claims priority to U.S. Provisional Application Ser. No. 62/805,600 filed Feb. 14, 2019, which is herein incorporated by reference in its entirety.

FIELD

Systems and methods are provided for production of lubricant base stocks from used lubricant.

BACKGROUND

Recycling used lubricants to form new base stocks poses a variety of challenges. Some of those challenges are related to the range of components present in such used lubricant oils. In addition to compounds traditionally found in lubricant base stocks, a used lubricant oil typically contains a wide variety of components that are unsuitable for a lubricant base stock such as the chemical additives that are typically added to finished lubricants as well as undesirably high concentrations of various metals and other components. For example, the chemical additives in finished lubricants are typically application-specific, and therefore are not desirable in a new lubricant base stock being formed from the used lubricant oil. The metals in used lubricant oils are either metals introduced in the chemical additives or wear metals that build up in the used oil during operation of the system that was being lubricated by the used oil. Additionally, used oils can also include oxidized species formed during use of the oil. Such metals and oxidized species are also not desirable in a new base stock.

Most conventional solutions for attempting to recycle used lubricant oils involve using a dedicated system for processing of the used oil. Using a dedicated system presents a variety of challenges and restrictions. For example, used oil re-refining is generally accomplished in purpose-built, smaller scale facilities that use a variety of either solvent extraction or hydrotreating facilities. Such purpose-built systems require their own refinery footprint, and such systems can be expensive both in terms of equipment and operating costs. Typically, the purpose-built systems result in generation of a "rejection" fraction in order to remove at least some undesirable components from the resulting lubricant base stock product. Additionally, due to variability in the amount and/or type of used oil that may be available, it is often difficult to continuously provide appropriate feed for a purpose-built used oil processing system. This lack of predictable down time for the purpose-built system will make it difficult to integrate a purpose-built system with other portions of a refinery or chemical plant whose reliable operation is usually a key to profitability.

Although recycling used oil to make new lubricants poses challenges, future regulations may mandate increased production of lubricants from used oils. For example, some regulations being considered in Europe could potentially require re-refining of up to 85% of used oils to form new lubricants. Thus, improved systems and methods for processing of used oils to form lubricant base stocks would be desirable.

U.S. Pat. No. 9,914,887 describes two-stage hydrocracking methods for heavy lubricating base oil from a heavy coker gas oil blended feedstock. The methods include performing separating the first stage hydrocracking product to form a light vacuum gas oil and a heavier fraction that is described as suitable for forming a heavy lubricant base oil. The light vacuum gas oil can then be passed into a second stage hydrocracker for further hydrocracking. The first stage can be operated under mild conditions suitable for upgrading of the heavy lubricant product, while the second stage can be operated under higher severity conditions suitable for removing undesirable components from fuel products formed from the light vacuum gas oil.

U.S. Pat. No. 9,677,013 describes a method for producing base lubricating oil from oils recovered from combustion engine service. The method includes a series of distillations, followed by performing solvent processing on a lubricant boiling range fraction generated by the series of separations to form a paraffinic fraction and a remaining or contaminant fraction. The paraffinic fraction can correspond to a lubricant base stock product. The contaminant fraction is then hydroprocessed to generate fuels and an additional lubricant base stock product. The method in U.S. Pat. No. 9,677,013 is an example of a method performed in a purpose-built system.

U.S. Patent Application Publication 2016/0298048 describes methods for production of lubricant base stocks from thermally cracked resids. Fluidized coking is described as an example of a method for thermally cracking a resid as part of production of lubricant base stocks.

SUMMARY

According to various embodiments, the present invention provides methods for producing a lubricant base oil product from a feed containing a used lubricant oil. In various aspects, the methods include exposing, in a reactor, a feed comprising: a) 0.5 wt % to 40 wt % of a used lubricant oil comprising a viscosity index of 70 or more, and b) a coker feedstock comprising a T10 distillation point of 450° C. or more, to a fluidized bed comprising solid particles under fluidized coking reactor conditions including a temperature of 510° C. or more to form a coker effluent. The fluidized coking conditions can provide 10 wt % or more conversion of the feedstock relative to 450° C., and are effective for depositing coke on the solid particles. The methods can further include passing at least a portion of the solid particles comprising deposited coke from the reactor to the coke combustion stage. The methods can further include removing a first portion of the partially combusted solid particles from the coke combustion stage, a rate of removal of the partially combusted solid particles comprising 1.5% or more on a weight basis of a rate of introduction of the feed into the reactor. The methods can further include separating at least a coker gas oil product from the coker effluent. Additionally, the methods can include hydroprocessing at least a portion of the separated coker gas oil product under effective hydroprocessing conditions to produce a hydroprocessed coker gas oil having a sulfur content of 100 wppm or less.

In some aspects, the reaction system used for performing the methods can also be used for processing other feeds that contain less than 0.1 wt % of used lubricant oil.

In some aspects, inclusion of used lubricant oil in the feed can provide an increase in viscosity index for the resulting hydroprocessed coker gas oil and/or a resulting lubricant base oil having a VI of 5 or more, 10 or more, or 15 or more or 20 or more relative to the feed without the used oil component processed under the same reaction conditions.

In various aspects, an integrated system for producing lubricant oils from a coker effluent is also provided. The system can include a fluidized bed coker comprising one or more coker feed inlets, a cold particle outlet, at least one hot particle inlet, and a coker product outlet. The system can further include a coke combustion reactor comprising: a coke combustion inlet in fluid communication with the cold particle outlet, a coke combustion outlet in fluid communication with the at least one hot particle inlet via at least one hot particle conduit, at least one coke combustion gas inlet, a particle purge outlet, and a fuel gas outlet. The system can further include a first separation stage comprising a first separation stage inlet in fluid communication with the coker product outlet, a first separation stage heavy product outlet and a first separation stage light product outlet. Additionally, the system can include one or more hydroprocessing stages comprising a hydroprocessing inlet in fluid communication with the first separation stage heavy product outlet and a hydroprocessing outlet.

DETAILED DESCRIPTION

Figure 1:
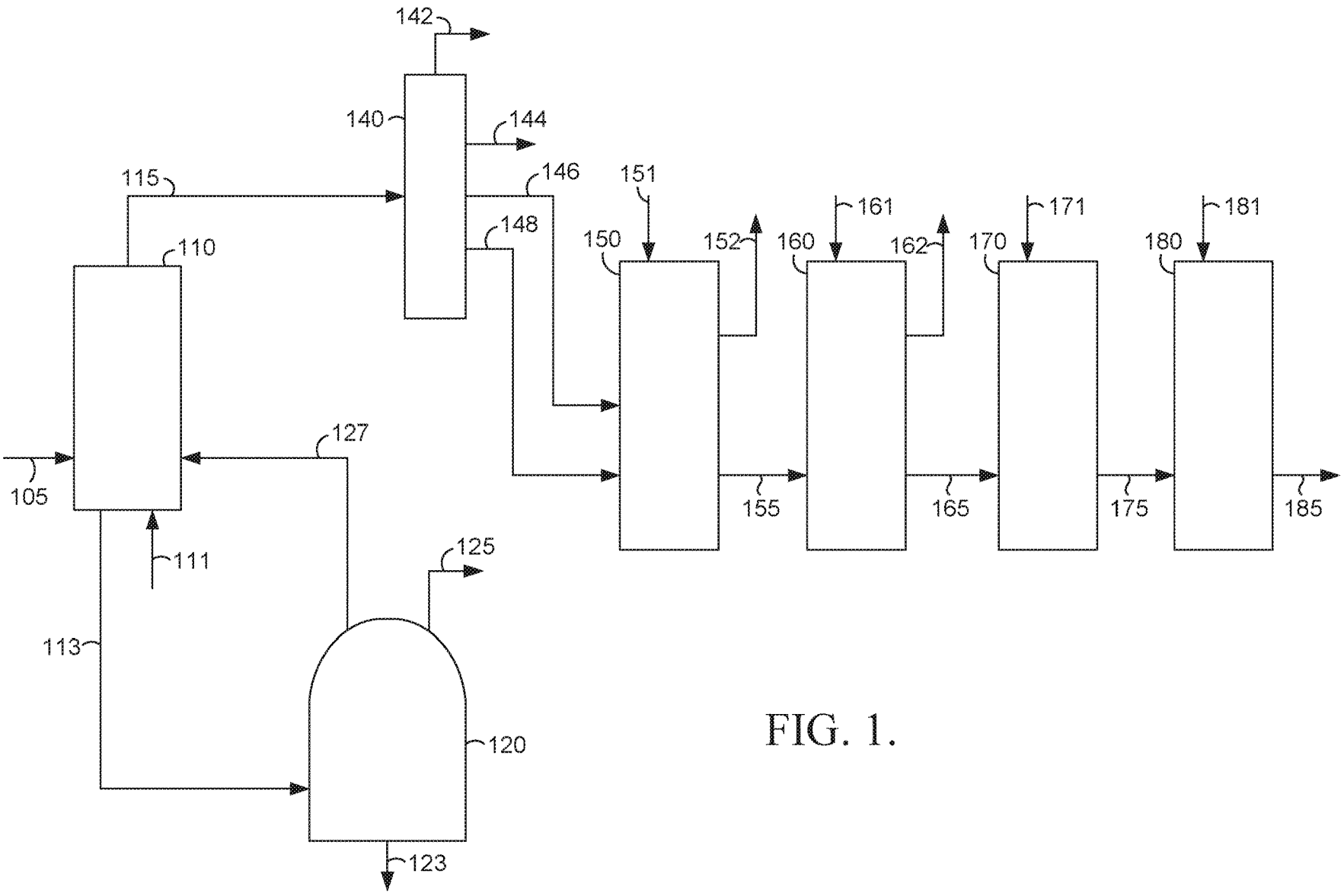
FIG. 1 shows an example of an integrated system for processing coker feed and used lubricant oil to form lubricant base stocks.

All numerical values within the detailed description and the claims herein are modified by "about" or "approximately" the indicated value, and take into account experimental error and variations that would be expected by a person having ordinary skill in the art.

Overview

In various aspects, systems and methods are provided for co-processing of used lubricant oils with a feedstock for fluidized coking to form lubricant base stocks. The present inventors unexpectedly discovered that fluidized coking removes contaminants and/or additives from used lubricant oils with modest conversion of the lubricant boiling range portions. Additionally, the present inventors unexpectedly discovered that the low nitrogen content in typical used lubricant oils is beneficial for hydroprocessing portions of fluidized coker effluent. In various embodiments, the present invention provides an integrated system that is not dedicated solely to the processing of feeds that contain used lubricating oil. This allows for much larger scale operations than would be possible with a dedicated system.

Fluidized coking processes, such as Flexicoking™, can be operated at commercial scale, for example, 10-50 thousand barrels per day, where the volume of the conventional coking feedstock is large relative to the availability of used lubricant oil. This allows for flexibility in processing. If used lubricant oil is available, the used lubricant oil can be incorporated into the feed to the fluidized coking system. If the used lubricant oil is not available, available in limited quantities, and/or it is desired to process a different used lubricant oil the operation of the fluidized coker and/or the feed rate of the conventional fluidized coking feed can be adjusted to allow continued operation of the fluidized coker. As a result, using fluidized coking as an initial step for processing of used lubricant oil can allow for integration of the processing of the used lubricant oil with a conventional refinery or chemical plant. It is noted that a used lubricant oil may correspond to a mixture of used oils from two or more sources. Thus, a difference between a first used lubricant oil and a second used lubricant oil could correspond to a difference in one of the oils used to form a used lubricant oil mixture.

During the fluidized coking, at least a portion of the metals from the used lubricant oil can become incorporated into the coke particles and/or the solid particles with deposited coke in the coking reactor. Such metals can then be removed from the coking system as part of a withdrawn coke particle/solid particle stream. Incorporating the metals from the used lubricant oil into the coke particles removed from the fluidized coking system can allow the metals to be incorporated into a typical refinery product, thus avoiding the need for a separate disposition for the used lubricant metals. This unexpected advantage can be realized by increasing the coke withdrawal or purge rate from the fluidized coking system. In some aspects, the coke withdrawal or purge rate can correspond to 1.5% or more on a weight basis of the rate of introduction of feed into the coking reactor. The withdrawn or purged coke can include 95 wt % or more of the combined metals from the coker feedstock and the used lubricant oil, or 98 wt % or more, or 99 wt % or more.

The present inventors unexpectedly discovered that fluidized coking is effective for conversion of higher boiling components of a used lubricant oil while having reduced or minimized impact on lubricant boiling range components. Typically, a formulated lubricant can include a variety of additives. Some additives can correspond to components boiling below the lubricant boiling range, while other additives can boil above the lubricant boiling range. Due to the relatively low volumes of additives, it can be difficult to directly separate such additives by simple distillation, and in practice most existing used oil refiners segregate and dispose of the heavier fraction into lower valued or challenged products. However, processing a used lubricant oil can facilitate separation in several ways. Coking processes typically generate light ends and coker naphtha as part of the process. To the degree that additives correspond to components boiling below the lubricant range such lower boiling additives can be separated out when the light ends and/or naphtha are separated from coker gas oil. With regard to higher boiling additives, the fluidized coking environment can be suitable for selectively cracking such higher boiling components to lower boiling compounds such as lube range or diesel/naphtha range materials as well as fuel gas. Thus, processing of used lubricant oil as part of an input feed to a fluidized coker can provide an unexpected benefit in reducing or minimizing the amount of pre-processing of the used lubricant that is required.

After coking, at least a portion of the coker gas oil product can be hydroprocessed to form lubricant base oils. This can include hydrotreating, hydrocracking, dewaxing, and/or aromatic saturation processes. One of the difficulties with attempting to process coker gas oils to form lubricant base oils is that coker gas oils can often have a substantial nitrogen content. By contrast, used lubricant base oils typically have a minimal nitrogen content. As a result, addition of used lubricant base oils into a fluidized coking feed can result in a coker gas oil with a reduced nitrogen content. Nitrogen is a catalyst poison for many types of hydroprocessing catalysts, such as many types of hydrocracking catalysts. By lowering the nitrogen content of the resulting coker gas oil, the inclusion of lubricant base oils in a fluidized coking feed can provide an unexpected synergy for downstream hydrotreating and/or hydrocracking of the coker gas oil.

In addition to providing a benefit for hydrotreatment and/or hydrocracking, inclusion of the used lubricant oil can also provide a benefit for the subsequent dewaxing step. The used lubricant corresponds to a high viscosity index portion of the feed to the dewaxing step, meaning that it already has a low wax content. This incorporation of a low wax content portion into the dewaxing step can allow for a reduction of processing severity. Although the amount of reduction in process severity may correspond to a few degrees in temperature, this reduction in process severity during dewaxing represents yet another unexpected synergy of co-processing used lubricant oil with a coker feed as a source of feedstock for lube production.

Additionally or alternately, incorporation of used lubricant oil into a fluidized coker feed can provide benefits for the viscosity index of a resulting lubricant base stock produced from the coker gas oil. Without being bound by any particular theory, it is believed that the fluidized coking conditions can result in reduced or minimized cracking of the portions of a used lubricant oil that boil in the coker gas oil range. In an aspect, the fluidized coking reactor is operated from 950° F. to 1100° F. (510° C. to 593° C.). In other aspects, the operating temperature is 950° F. to 1050° F. (510° C. to 566° C.), or 950° F. to 1000° F. (510° C. to 538° C.). As a result, the viscosity index of the used lubricant oil can be substantially preserved during coking. This can provide a viscosity index boost for the resulting coker gas oil, which can allow for creating of a higher viscosity index lubricant product and/or allow for increased yield due to lower severity hydrocracking conditions to achieve a target viscosity index.

Still another benefit of incorporation of used lubricant oil into a fluidized coker feed can be the unexpectedly high marginal yield of lubricant base stock derived from the used lubricant oil. In various aspects, the used lubricant oil is added as a minor component to form a total feed for fluidized coking that includes 60 wt % or more of conventional fluidized coker feed, or 75 wt % or more, or 85 wt % or more, such as up 99.5 wt % of conventional fluidized coker feed. Because the conventional coker feedstock corresponds to a major portion of the feed, and because a coker can typically operate in a normal manner with some feed variation, a marginal yield of products due to the presence of used lubricant oil can be defined. In this discussion, the marginal yield of a product derived from the used lubricant oil is defined relative to a product slate based on operation of the fluidized coker under substantially the same processing conditions, but using a feedstock corresponding to only the conventional coker feedstock portion of the feed. This means that the flow rate of the feed for the comparative coker operation will be reduced 0.5 wt % to 40 wt % relative to operation with the used lubricant oil, depending on the amount of used lubricant oil in the feed. Similarly, the hydroprocessing reactors can tolerate some variation in feed rate, thus allowing for comparison of product slates from the hydroprocessing.

Although various aspects herein are described based on use of a fluidized coker for initial processing of a used lubricant oil, other types of coking (such as delayed coking) may also be suitable. Using a delayed coker in place of a fluidized coker may require reducing the single pass conversion rate in the delayed coker to match typical operation of a fluidized coker.

After operating the fluidized coker and/or hydroprocessing sections with and without inclusion of the used lubricant oil in the coker feedstock, the product slates from the fluidized coking and/or the product slates after hydroprocessing can be compared. The difference between the product slate generated from the feed with the used lubricant oil and the product slate generated from the feed without the used lubricant oil can be defined as the marginal product yields based on inclusion of the used lubricant oil. In some aspects, the marginal yield of lubricant base stock from inclusion of used lubricant oil can correspond to 30 wt % or more of the used lubricant oil included in the feed, or 40 wt % or more, or 50 wt % or more, such as up to 70 wt % or possibly still higher.

In this discussion, conditions may be provided for various types of hydroprocessing of feeds or effluents. Examples of hydroprocessing can include, but are not limited to, one or more of hydrotreating, hydrocracking, catalytic dewaxing, and hydrofinishing/aromatic saturation. Such hydroprocessing conditions can be controlled to have desired values for the conditions (e.g., temperature, pressure, LHSV, treat gas rate) by using at least one controller, such as a plurality of controllers, to control one or more of the hydroprocessing conditions. In some aspects, for a given type of hydroprocessing, at least one controller can be associated with each type of hydroprocessing condition. In some aspects, one or more of the hydroprocessing conditions can be controlled by an associated controller. Examples of structures that can be controlled by a controller can include, but are not limited to, valves that control a flow rate, a pressure, or a combination thereof; heat exchangers and/or heaters that control a temperature; and one or more flow meters and one or more associated valves that control relative flow rates of at least two flows. Such controllers can optionally include a controller feedback loop including at least a processor, a detector for detecting a value of a control variable (e.g., temperature, pressure, flow rate, and a processor output for controlling the value of a manipulated variable (e.g., changing the position of a valve, increasing or decreasing the duty cycle and/or temperature for a heater). Optionally, at least one hydroprocessing condition for a given type of hydroprocessing may not have an associated controller.

One way of defining a feedstock is based on the boiling range of the feed. One option for defining a boiling range is to use an initial boiling point for a feed and/or a final boiling point for a feed. Another option, which in some instances may provide a more representative description of a feed, is to characterize a feed based on the amount of the feed that boils at one or more temperatures. For example, a "T5" boiling point for a feed is defined as the temperature at which 5 wt % of the feed will boil off. Similarly, a "T95" boiling point is a temperature at 95 wt % of the feed will boil.

In this discussion, a lubricant boiling range fraction and/or a gas oil fraction can correspond to a fraction having an initial boiling point or alternatively a T5 boiling point of at least 370° C. (~700° F.), or at least 750° F. (399° C.). Additionally or alternately, a lubricant boiling range fraction and/or gas oil fraction can have a final boiling point or alternatively a T95 boiling point, of 1050° F. (566° C.) or less, or 1000° F. (538° C.) or less.

Additionally or alternately, a distillate fuel boiling range fraction, such as a diesel product fraction, corresponds to a fraction having a boiling range from about 193° C. (375° F.) to about 370° C. (~700° F.). Thus, distillate fuel boiling range fractions (such as distillate fuel product fractions) can have initial boiling points (or alternatively T5 boiling points)

of at least about 193° C. and final boiling points (or alternatively T95 boiling points) of about 370° C. or less. A naphtha boiling range fraction corresponds to a fraction having a boiling range from about 36° C. (122° F.) to about 193° C. (375° F.) to about 370° C. (~700° F.). Thus, naphtha fuel product fractions can have initial boiling points (or alternatively T5 boiling points) of at least about 36° C. and final boiling points (or alternatively T95 boiling points) of about 193° C. or less. It is noted that 36° C. roughly corresponds to a boiling point for the various isomers of a $C_5$ alkane. A fuels boiling range fraction can correspond to a distillate fuel boiling range fraction, a naphtha boiling range fraction, or a fraction that includes both distillate fuel boiling range and naphtha boiling range components. Light ends are defined as products with boiling points below about 36° C., which include various $C_1$-$C_4$ compounds. When determining a boiling point or a boiling range for a feed or product fraction, an appropriate ASTM test method can be used, such as the procedures described in ASTM D2887, D2892, and/or D86. Preferably, ASTM D2887 should be used unless a sample is not appropriate for characterization based on ASTM D2887. For example, for samples that will not completely elute from a chromatographic column, ASTM D7169 can be used.

Feedstock—Coker Feed and Used Lubricant Oil

In accordance with various embodiments of the present invention, a gas oil portion of a coker effluent is used as an input stream for production of lubricant base stocks. According to various embodiments, the coker effluent is produced using a feed stock to the coker that includes at least a portion that is any suitable coker feedstock and at least a portion that is a used lubricant oil. In various aspects, the used lubricant oil corresponds to 0.5 wt % to 40 wt % of the total feed to the coker, or 0.5 wt % to 25 wt %, or 0.5 wt % to 15 wt %, or 1.5 wt % to 40 wt %, or 1.5 wt % to 25 wt %, or 1.5 wt % to 15 wt %, or 5.0 wt % to 40 wt %, or 5.0 wt % to 25 wt %. In some aspects, the balance of the feed can correspond to a coker feedstock, such as a fluidized coker feedstock. In other aspects, in addition to including 20 wt % or more, or 30% or more, or 40 wt % or more, or 50% or more or 60 wt % or more, or 70% or more, or 80% or more, or 90% or more, or or 95% or more of a (fluidized) coker feedstock, the feed can include any type of hydrocarbonaceous fraction that is compatible with (fluidized) coking, such as hydrocarbonaceous fractions having a boiling range corresponding to the distillate fuel boiling range or above.

Fluidized bed coking is a petroleum refining process in which heavy petroleum feeds, typically the non-distillable residues (resids) from the fractionation of heavy oils are converted to lighter, more useful products by thermal decomposition (coking) at elevated reaction temperatures, typically 480° C. to 590° C., (~900° F. to 1100° F.) and in most cases from 500° C. to 550° C. (~930° F. to 1020° F.). The present invention contemplates that any suitable coker feedstock may be combined with the used oil and optionally other materials. Coker feedstock includes, for example, heavy oils which may be processed by the fluid coking process including heavy hydrocarbonaceous oils, heavy and reduced petroleum crudes, heavy atmospheric resids, petroleum vacuum distillation bottoms, aromatic extracts, asphalts, shale oil, coal, coal slurries, liquid products derived from coal liquefaction processes, and bitumens from tar sands, tar pits and pitch lakes of Canada (Athabasca, Alta.), Trinidad, Southern California (La Brea (Los Angeles), McKittrick (Bakersfield, Calif.), Carpinteria (Santa Barbara County, Calif.), Lake Bermudez (Venezuela) and similar deposits such as those found in Texas, Peru, Iran, Russia and Poland, and any combination of any of the foregoing materials.

According to an embodiment, the coker feedstock is a hydrocarbonaceous feed that provides a Conradson carbon residue content of at least 5.0 wt %. According to various embodiments of the present invention, the coker feedstock has a Conradson carbon residue of at least 5.0 wt % to 50 wt %, or 6.0 wt % to 50 wt % or 7 wt % to 50 wt %, or 8 wt % to 50 wt % or 9 wt % to 50 wt % or 10 wt % to 50 wt %, or 10 wt % to 40 wt %. According to various embodiments, the coker feedstock has an API gravity of −10° to 35°, or −10° to 25°. According to various embodiments, the coker feedstock has a sulfur content of 1.0 wt % to 8.0 wt %, or 1.5 wt % to 6.0 wt %. In various embodiments the coker feedstock has a hydrogen content of 9.0 wt % to 11.0 wt %, or 9.0 wt % to 10.5 wt %. According to various embodiments the coker feedstock has a nitrogen content of 0.1 wt % to 2.0 wt %, or 0.2 wt % to 1.5 wt %. In various embodiments of the present invention, the coker feedstock has a carbon content of 80 wt % to 86 wt %. According to various embodiments of the present invention, the coker feedstock has a metals content of 1 wppm to 2000 wppm. In various aspect, the coker feedstock has a combination of any of the foregoing characteristics.

According to various embodiments of the present invention, the coker feedstock can include combinations of feeds where one or more of the feeds has a Conradson carbon residue contents of less than 5.0 wt %. For example, bio-derived feeds can be included as part of a coker feedstock. Other feed examples can include any type of hydrocarbonaceous feed that is a liquid at the inlet temperature for a fluidized coking reactor. Additionally or alternately, the feed to the fluidized bed coker can have a T10 distillation point of 450° C. or more, or 470° C. or more. In this discussion, any portions of the feedstock to the fluidized coker (other than the used lubricant oil) that have a T10 distillation point of 450° C. or more are defined as coker feedstock. Further additionally or alternately, coker feedstock can have a T90 distillation point of 600° C. or less.

Density, or weight per volume, of the heavy hydrocarbon can be determined according to ASTM D287-92 (2006) Standard Test Method for API Gravity of Crude Petroleum and Petroleum Products (Hydrometer Method), and is provided in terms of API gravity. In general, the higher the API gravity, the less dense the oil. API gravity is 20° or less in one aspect, 15° or less in another aspect, and 10° or less in another aspect.

Heavy oil feedstocks (also referred to as heavy oils) can be high in metals. For example, the heavy oil can be high in total nickel, vanadium and iron contents. In one embodiment, the heavy oil will contain at least 0.00005 grams of Ni/V/Fe (50 ppm) or at least 0.0002 grams of Ni/V/Fe (200 ppm) per gram of heavy oil, on a total elemental basis of nickel, vanadium and iron. In other aspects, the heavy oil can contain at least about 500 wppm of nickel, vanadium, and iron, such as at least about 1000 wppm.

Contaminants such as nitrogen and sulfur are typically found in heavy oils, often in organically-bound form. Nitrogen content can range from about 50 wppm to about 10,000 wppm elemental nitrogen or more, based on total weight of the heavy hydrocarbon component. The nitrogen containing compounds can be present as basic or non-basic nitrogen species. Examples of basic nitrogen species include quinolines and substituted quinolines. Examples of non-basic nitrogen species include carbazoles and substituted carbazoles. In some aspects, the nitrogen content of a heavy oil feed can be 2000 wppm to 10000 wppm, or 5000 wppm to 10000 wppm.

In some aspects, heavy oil feedstocks can contain at 500 wppm or more of elemental sulfur, based on total weight of the heavy oil. Generally, the sulfur content of such heavy oils can range from about 500 wppm to about 100,000 wppm elemental sulfur, or from about 1000 wppm to about 50,000 wppm, or from about 1000 wppm to about 30,000 wppm, based on total weight of the heavy component. Sulfur will usually be present as organically bound sulfur. Examples of such sulfur compounds include the class of heterocyclic sulfur compounds such as thiophenes, tetrahydrothiophenes, benzothiophenes and their higher homologs and analogs. Other organically bound sulfur compounds include aliphatic, naphthenic, and aromatic mercaptans, sulfides, and di- and polysulfides.

Heavy oils can be high in n-pentane asphaltenes. In some aspects, the heavy oil can contain at least about 5 wt % of n-pentane asphaltenes, such as at least about 10 wt % or at least 15 wt % n-pentane asphaltenes.

Still another method for characterizing a heavy oil feedstock is based on the Conradson carbon residue of the feedstock. The Conradson carbon residue of the feedstock can be 5.0 wt % or more, or 10 wt % or more, or 20 wt % or more, such as up to 50 wt % or possibly still higher. It is noted that a used lubricant oil can have a Conradson carbon residue of substantially less than 5.0 wt %, such as 2.0 wt % or less, or 1.0 wt % or less. In various aspects, the feedstock to the fluidized coker (including at least coker feedstock and used lubricant oil) can have a Conradson carbon residue of 5.0 wt % or more, in order to provide sufficient coke formation for operation of the fluidized coker.

The present invention contemplates the use of any suitable used lubricant oil. According to various embodiments, the used lubricant oil is a lubricant oil that has previously been used in lubricating service to reduce friction between adjacent surfaces. The lubricant oil can be any convenient type of lubricating oil, including but not limited to, engine oils (such as lubricating oils for spark ignition and diesel ignition engines); driveline oils (such as transmission fluids and gear oils); and industrial oils (such as circulating oils or hydraulic oils).

According to various embodiments of the present invention, the used lubricant oil is an untreated used lubricant oil, a pre-treated used lubricant oil, or a combination thereof. A pre-treated used lubricant oil is a used lubricant oil that has been exposed to one or more processes for removal of one or more components and/or contaminants. Examples of components and/or contaminants that can be removed during a pre-treatment process include, but are not limited to, metals, water, ethylene glycol, and other non-hydrocarbon species that may be present in a used lubricant oil. Examples of pre-treatment processes include, but are not limited to, metal extraction processes, water extraction processes, caustic treatment processes, and ethylene glycol removal processes. It is noted that sufficient pre-treatment may be performed to reduce the content of metals, ethylene glycol, and water, or the pre-treatment may reduce the content of one or more contaminants while allowing other contaminants to remain substantially at or near the amount present in the untreated used lubricant oil.

It is noted that the fluidized coking environment is compatible with having some water present in the feed to the fluidized coker. Because the majority of a feed to a fluidized coker is vaporized under fluidized coker reactor conditions, the vaporization of additional water in the feed does not present an unusual challenge for a fluidized coking reactor. This is in contrast to a delayed coking environment, where generation of a substantial vapor phase due to vaporization of water can be undesirable from a safety perspective. In some aspects, the used lubricant oil and/or the combined coker feedstock and used lubricant oil delivered to the fluidized coking reactor can have a water content of 500 wppm or more, or 700 wppm or more, such as up to 10,000 wppm or possibly still higher.

According to various embodiments, the used lubricant oil has a T10 distillation point of 370° C. or more, a T90 distillation point of 540° C. or less, or a combination thereof. Additionally or alternately, according to various embodiments, the used lubricant oil has a kinematic viscosity at 100° C. of 1.5 cSt to 40 cSt, or 1.5 cSt to 20 cSt, or 3.5 cSt to 20 cSt, or 5.5 cSt to 40 cSt.

In some aspects, the used lubricant oil has a content of corrosion metals (Fe, Pb, Cu) of 10 wppm or more, or 50 wppm or more, such as up to 500 wppm or possibly still higher. Additionally or alternately, in some aspects, the used lubricant oil has a content of Ni, V, or a combination thereof of 5 wppm or less, or 2 wppm or less. Additionally or alternately, in some aspects, the used lubricant oil has a content of detergent metals (such as Ca, Mg) of 100 wppm or more, or 200 wppm or more, such as up to 2000 wppm or possibly still higher. Additionally or alternately, in some aspects the used lubricant oil can has a content of additive metals (such as P, Zn) of 200 wppm or more, or 400 wppm or more, such as up to 4000 wppm or possibly still higher. It is noted that the above metal contents correspond to metal contents for an untreated used lubricant oil. If a pre-treatment is performed for metals removal, the metals content in the resulting pre-treated used lubricant oil can potentially be substantially lower.

In some aspects, the used lubricant oil can have a relatively high viscosity index. This can be due in part to the viscosity index of the underlying base stock in the used lubricant oil. This can optionally also be due in part to the presence of one or more additives that can enhance the viscosity index of a lubricant oil. The used lubricant oil, including the additives, can have a viscosity index of 70 or more, or 80 or more, or 100 or more, or 120 or more. For example, the viscosity index can be 70 to 180, or 70 to 120, or 80 to 180, or 80 to 150, or 100 to 180, or 100 to 150, or 120 to 180. Additionally or alternately, the base stock in the used lubricant oil can have a viscosity index of 70 or more, or 80 or more, or 100 or more, or 120 or more. For example, the viscosity index of the base oil in the used lubricant oil can be 70 to 150, or 70 to 100, or 80 to 150, or 80 to 120, or 100 to 150, or 100 to 120, or 120 to 150. Most typically the base oil from the used lubricant will be 90 to 120 or even 95 to 115. The elevated VI values of a used lubricant oil are in contrast to typical VI values for coker products. Coker products derived from traditional coker feeds can have VI values that are typically below 50, such as between 20 and 30 depending on the crude source for the coker feed. Thus the inclusion the base oil from used oil has the potential to significantly raise the VI of the combined coker product and thereby provide benefit to the overall production of base stock which is typically limited by VI. As an example, a feedstock composed of 90% of coker feedstock with a VI of less than 20 and 10% of a used lube oil with a VI of 100 or more will result in a coker effluent with a lubricant boiling range portion having a VI that is increased by 5 or more, or 10 or more or 15 or more, or 20 or more relative to a coker effluent generated from only the coker feedstock.

In various aspects, a used lubricant oil can have a total acid number (TAN) of greater than 1.0, or greater than 1.5, such as up to 3.5 or possibly more. This is in contrast to a lubricant oil prior to use in lubricating service, which typically has a TAN of less than 1.0. In some aspects, the used lubricant oil can include one or more additives with a boiling point that is above the lubricant boiling range. For example, the used lubricant oil can include 1.0 wt % to 5.0 wt % of additives with a boiling point of 1050° F. or more (~566° C. or more), or 1100° F. or more (~593° C. or more), or 1150° F. or more (~621° C. or more). Without being bound by any particular theory, the fluidized coking conditions (or other coking conditions) can be suitable for selectively converting such high boiling additives while causing reduced or minimized conversion of the base stock(s) in the used lubricant oil.

With regard to nitrogen and sulfur content, a used lubricant oil can typically have a sulfur content and a nitrogen content of 100 wppm or less. The nitrogen content of the used lubricant oil is in contrast to the nitrogen content of the coker feed, which can typically be 2000 wppm or more. Because of the low nitrogen content, addition of a few percent of used lubricant oil can result in a noticeable reduction in the nitrogen content of the overall combined feed. In the subsequent hydroprocessing of the gas oil portion of the coker effluent, this reduction in the nitrogen content can be beneficial for reducing the deactivation of hydroprocessing catalyst(s). This can allow the hydroprocessing to be performed at a lower temperature, thus extending the lifetime of the catalyst.

Configuration Example

FIG. 1 shows an example of a configuration for co-processing of a coker feed with used lubricant base oil. In some aspects, the configuration can be suitable for producing a gas oil boiling range product for use as a fuel product, such as a marine fuel or heating oil. In other aspects, the configuration can be suitable for producing a gas oil boiling range product suitable for use as a lubricant base stock. In addition to the gas oil boiling range product, the configuration can also generate additional distillate fuel and naphtha boiling range products.

In FIG. 1, a feed 105 including coker feedstock and used lubricant is introduced into a fluidized coking reactor 110. A heated coke stream 127 and a fluidizing stream 111 (such as steam) are also introduced into fluidized coking reactor 110, in order to provide the fluidized coking environment for the feed 105. Fluidized coking reactor 110 can generate a fluid effluent stream 115 and a solids stream 113 comprising solid particles (such as coke particles) that include coke deposited during the fluidized coking process. In the example shown in FIG. 1, solids stream 113 is passed into gasifier 120. In other aspects, other combinations of heaters, gasifiers, burners, and/or other combustors can be used, depending on the type of fluidized coking system. Coke from the solids stream 113 can be combusted in gasifier 120, allowing a heated coke stream 127 to be returned to the fluidized coking reactor 110. Gasifier 120 can also generate a coke particle removal stream 123 and an overhead gas stream 125. The quality of the overhead gas stream 125 can be dependent on the nature of the combustor used for the fluidized coking system.

The fluid effluent stream 115 can be separated in one or more separation stages to form various coking effluent streams. The one or more separation stages are represented in FIG. 1 by a fractionator 140. In the example shown in FIG. 1, fractionator 140 can generate a light ends stream 142, a coker naphtha stream 144, and one or more gas oil streams, such as a light gas oil stream 146 and a heavy gas oil stream 148.

At least a portion of the one or more gas oil streams can then be passed into one or more hydroprocessing stages. In the example shown in FIG. 1, the hydroprocessing stages include a hydrotreating stage 150, a hydrocracking stage 160, a catalytic dewaxing stage 170, and an aromatic saturation stage 180. It is noted that the various types of hydroprocessing can potentially be performed in various orders, and more or fewer stages could be used to provide the different types of hydroprocessing. Additionally, one or more types of hydroprocessing can be optional, depending on the configuration.

In the example shown in FIG. 1, light coker gas oil 146 and heavy coker gas oil 148 are passed into hydrotreating stage 150, along with hydrogen 151. The hydrotreating stage produces a hydrotreated effluent 155, along with one or more light products 152. It is noted that although a separate light products stream 152 is shown, in some aspects the entire effluent can be passed from hydrotreating stage 150 to hydrocracking stage 160. The hydrotreated effluent 155 can then be passed into hydrocracker 160, along with hydrogen 161. This can generate a hydrocracked effluent 165. It is noted that formation of separate light products stream 162 is optional. Depending on the aspect, a light products stream 152 and/or 162 can correspond to light ends, naphtha, or distillate fuel boiling range products. The hydrocracked effluent 165 can then optionally be passed into a dewaxing stage 170 to produce a dewaxed effluent 175, followed by passage into an aromatic saturation stage 180 to produce a hydrofinished product 185 that includes one or more lubricant base stock products. It is noted that hydrogen input streams 151, 161, 171, and 181 are shown as being separately passed into stages 150, 160, 170, and 180 respectively. In other aspects, hydrogen may be passed into less than all of the stages, with the hydrogen being transferred between stages along with the effluent flow. Still another option could be to have hydrogen that is passed between reactors in a counter-current manner relative to the feed flow. Yet other options can include any convenient method for providing hydrogen to the various hydroprocessing stages.

Initial Processing of Combined Feed—Fluidized Coking

Fluidized coking is carried out in a unit with a large reactor containing hot coke particles which are maintained in the fluidized condition at the required reaction temperature with steam injected at the bottom of the vessel with the average direction of movement of the coke particles being downwards through the bed. The heavy oil feed is heated to a pumpable temperature, typically in the range of 350° C. to 400° C. (~660° F. to 750° F.), mixed with atomizing steam, and fed through multiple feed nozzles arranged at several successive levels in the reactor. Steam (and/or another stripping gas) is injected into a stripping section at the bottom of the reactor and passes upwards through the coke particles descending through the dense phase of the fluid bed in the main part of the reactor above the stripping section. Part of the feed liquid coats the coke particles in the fluidized bed and is subsequently cracked into layers of solid coke and lighter products which evolve as gas or vaporized liquid. The residence time of the feed in the coking zone (where temperatures are suitable for thermal cracking) is on the order of 1 to 30 seconds. Reactor pressure is relatively low in order to favor vaporization of the hydrocarbon vapors which pass upwards from dense phase into dilute phase of the fluid bed in the coking zone and into cyclones at the top of the coking zone where most of the entrained solids are separated from the gas phase by centrifugal force in one or more cyclones and returned to the dense fluidized bed by gravity through the cyclone diplegs. The mixture of steam and hydrocarbon vapors from the reactor is subsequently discharged from the cyclone gas outlets into a scrubber section in a plenum located above the coking zone and separated from it by a partition. It is quenched in the scrubber section by contact with liquid descending over sheds. A pumparound loop circulates condensed liquid to an external cooler and back to the top shed row of the scrubber section to provide cooling for the quench and condensation of the heaviest fraction of the liquid product. This heavy fraction is typically recycled to extinction by feeding back to the coking zone in the reactor.

The coke particles formed in the coking zone pass downwards in the reactor and leave the bottom of the reactor vessel through a stripper section where they are exposed to steam in order to remove occluded hydrocarbons. The solid coke from the reactor, consisting mainly of carbon with lesser amounts of hydrogen, sulfur, nitrogen, and traces of vanadium, nickel, iron, and other elements derived from the feed, passes through the stripper and out of the reactor vessel to a burner or heater where it is partly burned in a fluidized bed with air to raise its temperature from 480° C. to 700° C. (~900° F. to 1300° F.) to supply the heat required for the endothermic coking reactions, after which a portion of the hot coke particles is recirculated to the fluidized bed reaction zone to transfer the heat to the reactor and to act as nuclei for the coke formation. The balance is withdrawn as coke product. The net coke yield is only about 65 percent of that produced by delayed coking. In various aspects, the net conversion of the 1050° F.+(566° C.+) portion of the feed is 90% or more, or 95% or more, or 98% or more. The net conversion is defined herein as including conversion of 566° C.+ portions of a feed into either coke or lower boiling components (i.e., 566° C.– components).

The Flexicoking™ process, developed by Exxon Research and Engineering Company, is a variant of the fluid coking process that is operated in a unit including a reactor and a heater, but also including a gasifier for gasifying the coke product by reaction with an air/steam mixture to form a low heating value fuel gas. A stream of coke passes from the heater to the gasifier where all but a small fraction of the coke is gasified to a low-BTU gas (~120 BTU/standard cubic feet) by the addition of steam and air in a fluidized bed in an oxygen-deficient environment to form fuel gas comprising carbon monoxide and hydrogen. In a conventional Flexicoking™ configuration, the fuel gas product from the gasifier, containing entrained coke particles, is returned to the heater to provide most of the heat required for thermal cracking in the reactor with the balance of the reactor heat requirement supplied by combustion in the heater. The liquid yield and properties are comparable to those from fluid coking. The fuel gas product is withdrawn from the heater following separation in internal cyclones which return coke particles through their diplegs. It is noted that in some configurations, the heater can be omitted, so that coke particles are passed directly between the reactor and the gasifier.

During a typical Flexicoking™ process, a small amount of net coke (about 1.0 weight percent of feed) is withdrawn from the heater to purge the system of metals and ash. It is noted that due to the additional metals present in a used lubricating oil, it may be desirable to increase the amount of coke product that is withdrawn from the fluidized coking system. Increasing the withdrawal rate of the coke product can reduce or minimize formation of slag within the gasifier of a Flexicoking™ system. The increased rate of coke withdrawal can correspond to 1.5 wt % of the feed or more, or 2.0 wt % or more, such as up to 4.0 wt % or possibly still higher. The withdrawn coke can include 95 wt % or more of the combined metals from the coker feedstock and the used lubricant oil, or 98 wt % or more, or 99 wt % or more, such as up to substantially all of the combined metals present in the coker feedstock and the used lubricant oil. Alternately, in some aspects, a fluid coker can be used that is not connected to a gasification section. In such aspects, approximately 50 to 90% of the coke is withdrawn from the unit as a coke product.

Figure 2:
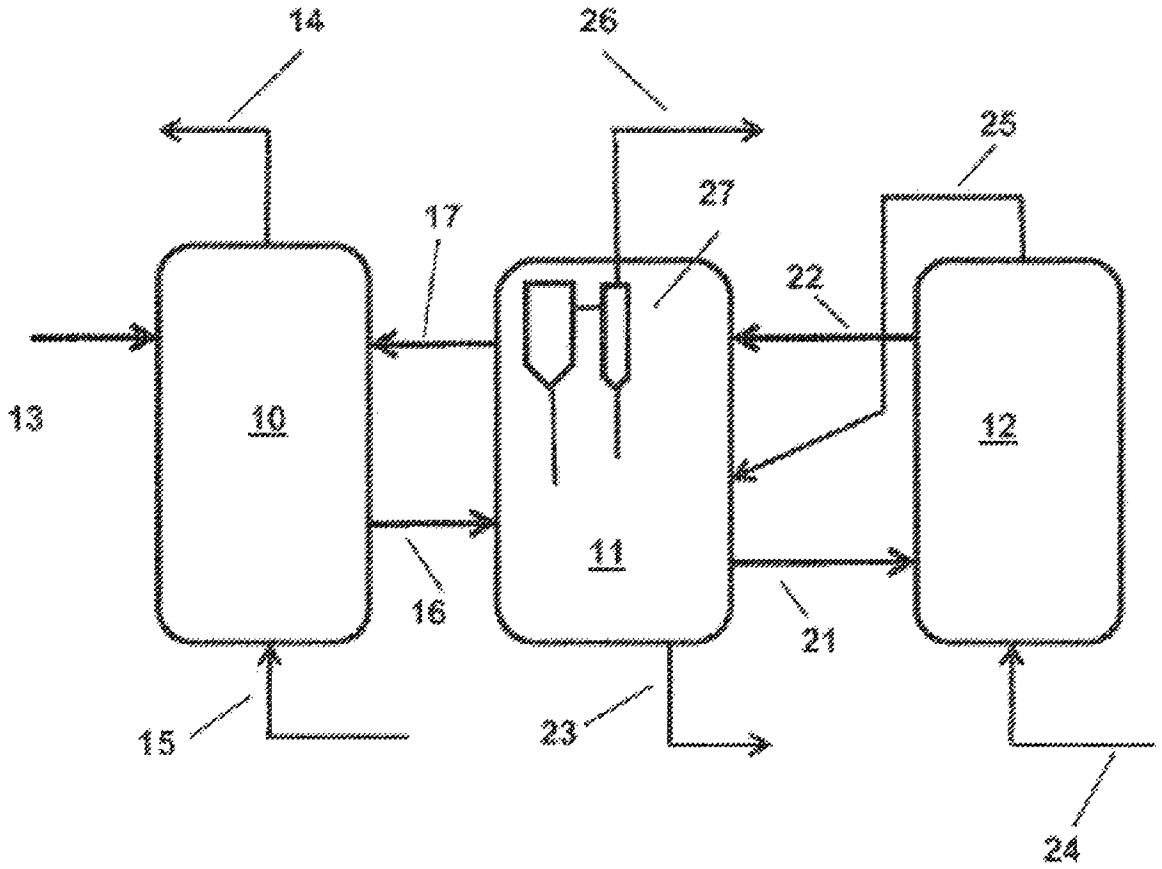
FIG. 2 shows an example of a fluidized bed coking system including a coker, a heater, and a gasifier.

FIG. 2 shows an example of a Flexicoker unit (i.e., a system including a gasifier that is thermally integrated with a fluidized bed coker) with three reaction vessels: reactor, heater and gasifier. The unit comprises reactor section 10 with the coking zone and its associated stripping and scrubbing sections (not separately indicated), heater section 11 and gasifier section 12. The relationship of the coking zone, scrubbing zone and stripping zone in the reactor section is shown, for example, in U.S. Pat. No. 5,472,596, to which reference is made for a description of the Flexicoking unit and its reactor section. A heavy oil feed is introduced into the unit by line 13 and cracked hydrocarbon product withdrawn through line 14. Fluidizing and stripping steam is supplied by line 15. Cold coke is taken out from the stripping section at the base of reactor 10 by means of line 16 and passed to heater 11. The term "cold" as applied to the temperature of the withdrawn coke is, of course, decidedly relative since it is well above ambient at the operating temperature of the stripping section. Hot coke is circulated from heater 11 to reactor 10 through line 17. Coke from heater 11 is transferred to gasifier 12 through line 21 and hot, partly gasified particles of coke are circulated from the gasifier back to the heater through line 22. The excess coke is withdrawn from the heater 11 by way of line 23. In conventional configurations, gasifier 12 is provided with its supply of steam and air by line 24 and hot fuel gas is taken from the gasifier to the heater though line 25. The fuel gas is taken out from the unit through line 26 on the heater; coke fines are removed from the fuel gas in heater cyclone system 27 comprising serially connected primary and secondary cyclones with diplegs which return the separated fines to the fluid bed in the heater. The fuel gas from line 26 can then undergo further processing.

It is noted that in some optional aspects, heater cyclone system 27 can be located in a separate vessel (not shown) rather than in heater 11. In such aspects, line 26 can withdraw the fuel gas from the separate vessel, and the line 23 for purging excess coke can correspond to a line transporting coke fines away from the separate vessel. These coke fines and/or other partially gasified coke particles that are vented from the heater (or the gasifier) can have an increased content of metals relative to the feedstock. For example, the weight percentage of metals in the coke particles vented from the system (relative to the weight of the vented particles) can be greater than the weight percent of metals in the feedstock (relative to the weight of the feedstock). In other words, the metals from the feedstock are concentrated in the vented coke particles. Since the gasifier conditions do not create slag, the vented coke particles correspond to the mechanism for removal of metals from the coker/gasifier environment. In some aspects, the metals can correspond to a combination of nickel, vanadium, and/or iron. Additionally or alternately, the gasifier conditions can cause substantially no deposition of metal oxides on the interior walls of the gasifier, such as deposition of less than 0.1 wt % of the metals present in the feedstock introduced into the coker/gasifier system, or less than 0.01 wt %.

In configurations such as FIG. 2, the system elements shown in the figure can be characterized based on fluid communication between the elements. For example, reactor section 10 is in direct fluid communication with heater 11. Reactor section 10 is also in indirect fluid communication with gasifier 12 via heater 11.

As an alternative, integration of a fluidized bed coker with a gasifier can also be accomplished without the use of an intermediate heater. In such alternative aspects, the cold coke from the reactor can be transferred directly to the gasifier. This transfer, in almost all cases, will be unequivocally direct with one end of the tubular transfer line connected to the coke outlet of the reactor and its other end connected to the coke inlet of the gasifier with no intervening reaction vessel, i.e. heater. The presence of devices other than the heater is not however to be excluded, e.g. inlets for lift gas etc. Similarly, while the hot, partly gasified coke particles from the gasifier are returned directly from the gasifier to the reactor this signifies only that there is to be no intervening heater as in the conventional three-vessel Flexicoker™ but that other devices may be present between the gasifier and the reactor, e.g. gas lift inlets and outlets.

Figure 3:
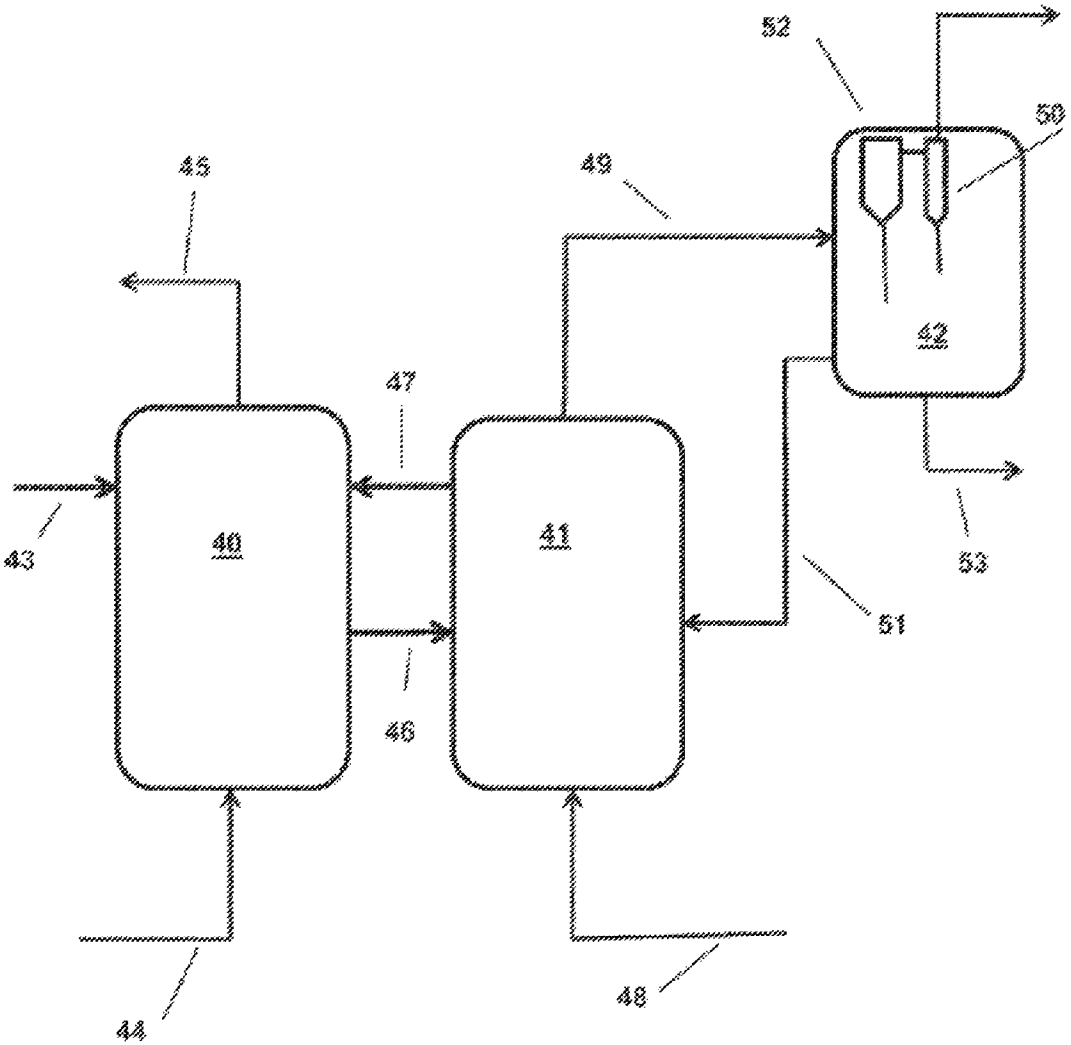
FIG. 3 shows an example of a fluidized bed coking system including a coker and a gasifier.

FIG. 3 shows an example of integration of a fluidized bed coker with a gasifier but without a separate heater vessel. In the configuration shown in FIG. 3, the cyclones for separating fuel gas from catalyst fines are located in a separate vessel. In other aspects, the cyclones can be included in gasifier vessel 41.

In the configuration shown in FIG. 3, the configuration includes a reactor 40, a main gasifier vessel 41 and a separator 42. The heavy oil feed is introduced into reactor 40 through line 43 and fluidizing/stripping gas through line 44; cracked hydrocarbon products are taken out through line 45. Cold, stripped coke is routed directly from reactor 40 to gasifier 41 by way of line 46 and hot coke returned to the reactor in line 47. Steam and oxygen are supplied through line 48. The flow of gas containing coke fines is routed to separator vessel 42 through line 49 which is connected to a gas outlet of the main gasifier vessel 41. The fines are separated from the gas flow in cyclone system 50 comprising serially connected primary and secondary cyclones with diplegs which return the separated fines to the separator vessel. The separated fines are then returned to the main gasifier vessel through return line 51 and the fuel gas product taken out by way of line 52. Coke is purged from the separator through line 53. The fuel gas from line 52 can then undergo further processing for separation of $CO_2$ (and/or $H_2S$) and conversion of synthesis gas to methanol.

During operation of a fluidized coking system (such as a Flexicoking™ system), the heavy oil feed, pre-heated to a temperature at which it is flowable and pumpable, is introduced into the coking reactor towards the top of the reactor vessel through injection nozzles which are constructed to produce a spray of the feed into the bed of fluidized coke particles in the vessel. Temperatures in the coking zone of the reactor are typically in the range of 450° C. to 650° C. and pressures are kept at a relatively low level, typically in the range of 0 kPag to 700 kPag (~0 psig to 100 psig), and most usually from 35 kPag to 320 kPag (~5 psig to 45 psig), in order to facilitate fast drying of the coke particles, preventing the formation of sticky, adherent high molecular weight hydrocarbon deposits on the particles which could lead to reactor fouling. In some aspects, the temperature in the coking zone can be 450° C. to 600° C., or 450° C. to 550° C. The conditions can be selected so that a desired amount of conversion of the feedstock occurs in the fluidized bed reactor. For example, the conditions can be selected to achieve at least 10 wt % conversion relative to 343° C. (or 370° C.), or at least 20 wt % conversion relative 343° C. (or 370° C.), or at least 40 wt % conversion relative to 343° C. (or 370° C.), such as up to 80 wt % conversion or possibly still higher. The light hydrocarbon products of the coking (thermal cracking) reactions vaporize, mix with the fluidizing to steam and pass upwardly through the dense phase of the fluidized bed into a dilute phase zone above the dense fluidized bed of coke particles. This mixture of vaporized hydrocarbon products formed in the coking reactions flows upwardly through the dilute phase with the steam at superficial velocities of roughly 1 to 2 meters per second (~3 to 6 feet per second), entraining some fine solid particles of coke which are separated from the cracking vapors in the reactor cyclones as described above. In aspects where steam is used as the fluidizing agent, the weight of steam introduced into the reactor can be selected relative to the weight of feedstock introduced into the reactor. For example, the mass flow rate of steam into the reactor can correspond to 6.0% of the mass flow rate of feedstock, or 8.0% or more, such as up to 10% or possibly still higher. The cracked hydrocarbon vapors pass out of the cyclones into the scrubbing section of the reactor and then to product fractionation and recovery.

As the cracking process proceeds in the reactor, the coke particles pass downwardly through the coking zone, through the stripping zone, where occluded hydrocarbons are stripped off by the ascending current of fluidizing gas (steam). They then exit the coking reactor and pass to the gasification reactor (gasifier) which contains a fluidized bed of solid particles and which operates at a temperature higher than that of the reactor coking zone. In the gasifier, the coke particles are converted by reaction at the elevated temperature with steam and an oxygen-containing gas into a fuel gas comprising carbon monoxide and hydrogen.

The gasification zone is typically maintained at a high temperature ranging from 850° C. to 1000° C. (~1560° F. to 1830° F.) and a pressure ranging from 0 kPag to 1000 kPag (~0 psig to 150 psig), preferably from 200 kPag to 400 kPag (~30 psig to 60 psig). Steam and an oxygen-containing gas are introduced to provide fluidization and an oxygen source for gasification. In some aspects the oxygen-containing gas can be air. In other aspects, the oxygen-containing gas can have a low nitrogen content, such as oxygen from an air separation unit or another oxygen stream including 95 vol % or more of oxygen, or 98 vol % or more, are passed into the gasifier for reaction with the solid particles comprising coke deposited on them in the coking zone. In aspects where the oxygen-containing gas has a low nitrogen content, a separate diluent stream, such as a recycled $CO_2$ or $H_2S$ stream derived from the fuel gas produced by the gasifier, can also be passed into the gasifier.

In the gasification zone the reaction between the coke and the steam and the oxygen-containing gas produces a hydrogen and carbon monoxide-containing fuel gas and a partially gasified residual coke product. Conditions in the gasifier are selected accordingly to generate these products. Steam and oxygen rates (as well as any optional $CO_2$ rates) will depend upon the rate at which cold coke enters from the reactor and to a lesser extent upon the composition of the coke which, in turn will vary according to the composition of the heavy oil feed and the severity of the cracking conditions in the reactor with these being selected according to the feed and the range of liquid products which is required. The fuel gas product from the gasifier may contain entrained coke solids and these are removed by cyclones or other separation techniques in the gasifier section of the unit; cyclones may be internal cyclones in the main gasifier vessel itself or external in a separate, smaller vessel as described below. The fuel gas product is taken out as overhead from the gasifier cyclones. The resulting partly gasified solids are removed from the gasifier and introduced directly into the coking zone of the coking reactor at a level in the dilute phase above the lower dense phase.

Figure 4:
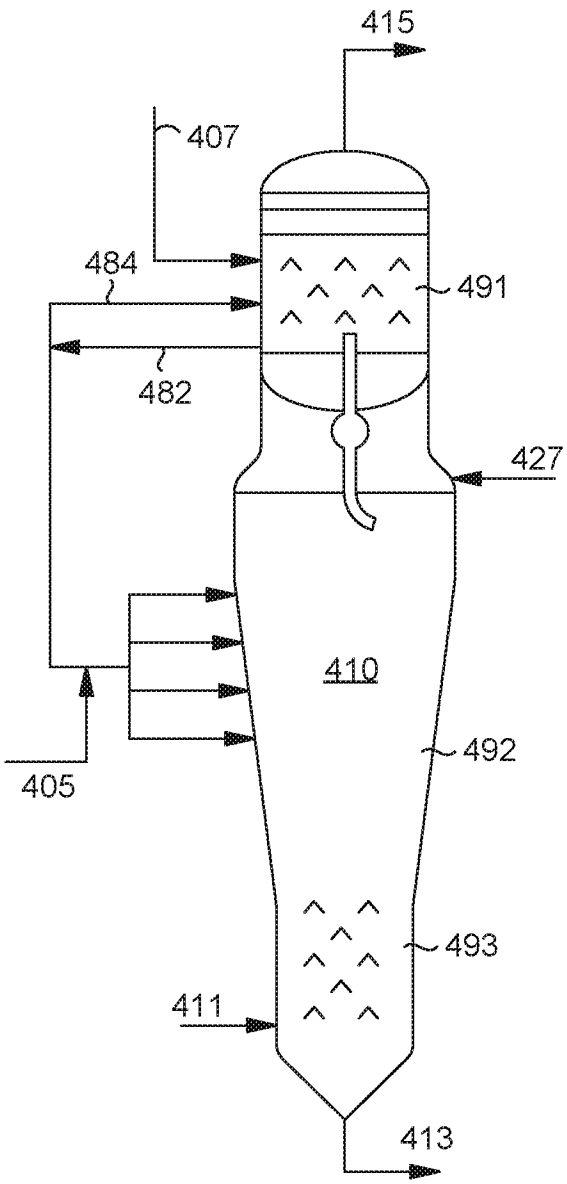
FIG. 4 shows an example of a reactor for a fluidized bed coking system.

In some aspects, additional advantages can be obtained by introducing the used lubricant oil and the coker feedstock at different locations within the coking reactor. FIG. 4 shows an example of a coking reactor 410 that includes additional details. In FIG. 4, the coking reactor 410 is shown as having at least three zones, corresponding to a stripping zone 493, a coking zone 492, and a scrubbing zone 491.

In the stripping zone 493, steam 411 (or another fluidizing gas) is introduced into the stripping zone 493 to fluidize the coke particles and/or other solid particles. The steam 411 also can strip at least a portion of any hydrocarbons remaining on the solid particles prior to the solid particles exiting 413 for passage to a heater, gasifier, or other coke combustion vessel. Heated solid particles from the heater, gasifier, or other coke combustion vessel can then be returned via hot particle line 427 to provide heat for reactor 410. Feed 405 corresponds to the conventional coker feedstock portion of the feed to the coking reactor. In the example shown in FIG. 4, a portion of the liquid product 482 withdrawn from the scrubbing zone 491 can be combined with the feed 405 prior to entering reactor 410. A second portion 484 of liquid product 482 can be used as a reflux stream for the scrubbing zone 491. A used lubricant oil portion of the feed can be introduced as stream 407 at a convenient location, such as into scrubbing zone 491.

Hydrotreating and Hydrocracking

After fluidized coking, at least a portion of the coker gas oil can undergo further processing to form lubricant base stocks. This can include hydrotreatment and/or hydrocracking to remove heteroatoms to desired levels, reduce Conradson Carbon content, and/or provide viscosity index (VI) uplift. Depending on the aspect, a coker gas oil can be hydroprocessed by hydrotreating, hydrocracking, or hydrotreating and hydrocracking. Optionally, the hydroprocessing can further include exposing at least a portion of the hydrotreated and/or hydrocracked gas oil to dewaxing conditions, aromatic saturation conditions, or a combination thereof. In some aspects, the hydroprocessing of the portion of the coker gas oil can correspond to to co-processing, where another suitable feed for forming lubricant base stocks is also hydroprocessed. Various types of vacuum gas oil fractions are examples of suitable feeds for lubricant base stock production.

The reaction conditions during hydrotreatment and/or hydrocracking of the deasphalted oil can be selected to generate a desired level of conversion of a feed. Any convenient type of reactor, such as fixed bed (for example trickle bed) reactors can be used. Conversion of the feed can be defined in terms of conversion of molecules that boil above a temperature threshold to molecules below that threshold. The conversion temperature can be any convenient temperature, such as ~700° F. (370° C.) or 1050° F. (566° C.). The amount of conversion can correspond to the total conversion of molecules within the combined hydrotreatment and hydrocracking stages. Suitable amounts of conversion of molecules boiling above ~700° F. (370° C.) to molecules boiling below 370° C. can be 10 wt % to 70 wt % conversion relative to 370° C., or 20 wt % to 50 wt %, or 30 wt % to 60 wt %.

One of the benefits of performing hydrotreating and/or hydrocracking can be to reduce the sulfur content and the nitrogen content of the resulting hydroprocessed effluent. After hydrotreating and/or hydrocracking, the hydroprocessed effluent can have a sulfur content of 200 wppm or less, or 100 wppm or less, or 50 wppm or less (such as down to ~0 wppm). Additionally or alternately, the hydroprocessed effluent can have a nitrogen content of 200 wppm or less, or 100 wppm or less, or 50 wppm or less (such as down to ~0 wppm).

In various aspects, the coker gas oil can be exposed to a hydrotreating catalyst under effective hydrotreating conditions. The catalysts used can include conventional hydroprocessing catalysts, such as those comprising at least one Group VIII non-noble metal (Columns 8-10 of IUPAC periodic table), preferably Fe, Co, and/or Ni, such as Co and/or Ni; and at least one Group VI metal (Column 6 of IUPAC periodic table), preferably Mo and/or W. Such hydroprocessing catalysts optionally include transition metal sulfides that are impregnated or dispersed on a refractory support or carrier such as alumina and/or silica. The support or carrier itself typically has no significant/measurable catalytic activity. Substantially carrier- or support-free catalysts, commonly referred to as bulk catalysts, generally have higher volumetric activities than their supported counterparts.

The catalysts can either be in bulk form or in supported form. In addition to alumina and/or silica, other suitable support/carrier materials can include, but are not limited to, zeolites, titania, silica-titania, and titania-alumina. Generally, any convenient size, shape, and/or pore size distribution for a catalyst suitable for hydrotreatment of a distillate (including lubricant base stock) boiling range feed in a conventional manner may be used. Preferably, the support or carrier material is an amorphous support, such as a refractory oxide.

The at least one Group VIII non-noble metal, in oxide form, can typically be present in an amount ranging from about 2 wt % to about 40 wt %, preferably from about 4 wt % to about 15 wt %. The at least one Group VI metal, in oxide form, can typically be present in an amount ranging from about 2 wt % to about 70 wt %, preferably for supported catalysts from about 6 wt % to about 40 wt % or from about 10 wt % to about 30 wt %. These weight percents are based on the total weight of the catalyst. Suitable metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina, silica, silica-alumina, or titania.

The hydrotreatment is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen "treat gas," is provided to the reaction zone. Treat gas, as referred to in this invention, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane). The treat gas stream introduced into a reaction stage will preferably contain at least about 50 vol. % and more preferably at least about 75 vol. % hydrogen. Optionally, the hydrogen treat gas can be substantially free (less than 1 vol %) of impurities such as $H_2S$ and $NH_3$ and/or such impurities can be substantially removed from a treat gas prior to use.

Hydrogen can be supplied at a rate of from about 100 SCF/B (standard cubic feet of hydrogen per barrel of feed) (17 $Nm^3/m^3$) to about 10000 SCF/B (1700 $Nm^3/m^3$). Preferably, the hydrogen is provided in a range of from about 200 SCF/B (34 $Nm^3/m^3$) to about 2500 SCF/B (420 $Nm^3/m^3$). Hydrogen can be supplied co-currently with the input feed to the hydrotreatment reactor and/or reaction zone or separately via a separate gas conduit to the hydrotreatment zone.

Hydrotreating conditions can include temperatures of 200° C. to 450° C., or 315° C. to 425° C.; pressures of 250 psig (1.8 MPag) to 5000 psig (34.6 MPag) or 300 psig (2.1 MPag) to 3000 psig (20.8 MPag); liquid hourly space velocities (LHSV) of 0.1 $hr^{-1}$ to 10 $hr^{-1}$; and hydrogen treat rates of 200 scf/B (35.6 $m^3/m^3$) to 10,000 scf/B (1781 $m^3/m^3$), or 500 (89 $m^3/m^3$) to 10,000 scf/B (1781 $m^3/m^3$).

In various aspects, the coker gas oil can be exposed to a hydrocracking catalyst under effective hydrocracking conditions. Hydrocracking catalysts typically contain sulfided base metals on acidic supports, such as amorphous silica alumina, cracking zeolites such as USY, or acidified alumina. Often these acidic supports are mixed or bound with other metal oxides such as alumina, titania or silica. Examples of suitable acidic supports include acidic molecular sieves, such as zeolites or silicoaluminophophates. One example of suitable zeolite is USY, such as a USY zeolite with cell size of 24.30 Angstroms or less. Additionally or alternately, the catalyst can be a low acidity molecular sieve, such as a USY zeolite with a Si to Al ratio of at least about 20, and preferably at least about 40 or 50. ZSM-48, such as ZSM-48 with a $SiO_2$ to $Al_2O_3$ ratio of about 110 or less, such as about 90 or less, is another example of a potentially suitable hydrocracking catalyst. Still another option is to use a combination of USY and ZSM-48. Still other options include using one or more of zeolite Beta, ZSM-5, ZSM-35, or ZSM-23, either alone or in combination with a USY catalyst. Non-limiting examples of metals for hydrocracking catalysts include metals or combinations of metals that include at least one Group VIII metal, such as nickel, nickel-cobalt-molybdenum, cobalt-molybdenum, nickel-tungsten, nickel-molybdenum, and/or nickel-molybdenum-tungsten. Additionally or alternately, hydrocracking catalysts with noble metals can also be used. Non-limiting examples of noble metal catalysts include those based on platinum and/or palladium. Support materials which may be used for both the noble and non-noble metal catalysts can comprise a refractory oxide material such as alumina, silica, alumina-silica, kieselguhr, diatomaceous earth, magnesia, zirconia, or combinations thereof, with alumina, silica, alumina-silica being the most common (and preferred, in one embodiment).

When only one hydrogenation metal is present on a hydrocracking catalyst, the amount of that hydrogenation metal can be at least about 0.1 wt % based on the total weight of the catalyst, for example at least about 0.5 wt % or at least about 0.6 wt %. Additionally or alternately when only one hydrogenation metal is present, the amount of that hydrogenation metal can be about 5.0 wt % or less based on the total weight of the catalyst, for example about 3.5 wt % or less, about 2.5 wt % or less, about 1.5 wt % or less, about 1.0 wt % or less, about 0.9 wt % or less, about 0.75 wt % or less, or about 0.6 wt % or less. Further additionally or alternately when more than one hydrogenation metal is present, the collective amount of hydrogenation metals can be at least about 0.1 wt % based on the total weight of the catalyst, for example at least about 0.25 wt %, at least about 0.5 wt %, at least about 0.6 wt %, at least about 0.75 wt %, or at least about 1 wt %. Still further additionally or alternately when more than one hydrogenation metal is present, the collective amount of hydrogenation metals can be about 35 wt % or less based on the total weight of the catalyst, for example about 30 wt % or less, about 25 wt % or less, about 20 wt % or less, about 15 wt % or less, about 10 wt % or less, or about 5 wt % or less. In embodiments wherein the supported metal comprises a noble metal, the amount of noble metal(s) is typically less than about 2 wt %, for example less than about 1 wt %, about 0.9 wt % or less, about 0.75 wt % or less, or about 0.6 wt % or less. It is noted that hydrocracking under sour conditions is typically performed using a base metal (or metals) as the hydrogenation metal.

In various aspects, the conditions selected for hydrocracking for lubricant base stock production can depend on the desired level of conversion, the level of contaminants in the input feed to the hydrocracking stage, and potentially other factors. For example, hydrocracking conditions in a single stage, or in the first stage and/or the second stage of a multi-stage system, can be selected to achieve a desired level of conversion in the reaction system. Hydrocracking conditions can be referred to as sour conditions or sweet conditions, depending on the level of sulfur and/or nitrogen present within a feed. For example, a feed with 100 wppm or less of sulfur and 50 wppm or less of nitrogen, preferably less than 25 wppm sulfur and/or less than 10 wppm of nitrogen, represent a feed for hydrocracking under sweet conditions. In various aspects, hydrocracking can be performed on a thermally cracked resid, such as a deasphalted oil derived from a thermally cracked resid. In some aspects, such as aspects where an optional hydrotreating step is used prior to hydrocracking, the thermally cracked resid may correspond to a sweet feed. In other aspects, the thermally cracked resid may represent a feed for hydrocracking under sour conditions.

A hydrocracking process under sour conditions can be carried out at temperatures of about 550° F. (288° C.) to about 840° F. (449° C.), hydrogen partial pressures of from about 1500 psig to about 5000 psig (10.3 MPag to 34.6 MPag), liquid hourly space velocities of from 0.05 $h^{-}1$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 1500 psig to about 3000 psig (10.3 MPag-20.9 MPag), and hydrogen treat gas rates of from about 213 $m^3/m^3$ to about 1068 $m^3/m^3$ (1200 SCF/B to 6000 SCF/B). The LHSV can be from about 0.25 $h^{-1}$ to about 50 $h^{-1}$, or from about 0.5 $h^{-1}$ to about 20 $h^{-1}$, preferably from about 1.0 $h^{-1}$ to about 4.0 $h^{-1}$.

In some aspects, a portion of the hydrocracking catalyst can be contained in a second reactor stage. In such aspects, a first reaction stage of the hydroprocessing reaction system can include one or more hydrotreating and/or hydrocracking catalysts. The conditions in the first reaction stage can be suitable for reducing the sulfur and/or nitrogen content of the feedstock. A separator can then be used in between the first and second stages of the reaction system to remove gas phase sulfur and nitrogen contaminants. One option for the separator is to simply perform a gas-liquid separation to remove contaminant. Another option is to use a separator such as a flash separator that can perform a separation at a higher temperature. Such a high temperature separator can be used, for example, to separate the feed into a portion boiling below a temperature cut point, such as about 350° F. (177° C.) or about 400° F. (204° C.), and a portion boiling above the temperature cut point. In this type of separation, the naphtha boiling range portion of the effluent from the first reaction stage can also be removed, thus reducing the volume of effluent that is processed in the second or other subsequent stages. Of course, any low boiling contaminants in the effluent from the first stage would also be separated into the portion boiling below the temperature cut point. If sufficient contaminant removal is performed in the first stage, the second stage can be operated as a "sweet" or low contaminant stage.

Still another option can be to use a separator between the first and second stages of the hydroprocessing reaction system that can also perform at least a partial fractionation of the effluent from the first stage. In this type of aspect, the effluent from the first hydroprocessing stage can be separated into at least a portion boiling below the distillate (such as diesel) fuel range, a portion boiling in the distillate fuel range, and a portion boiling above the distillate fuel range. The distillate fuel range can be defined based on a conventional diesel boiling range, such as having a lower end cut point temperature of at least about 350° F. (177° C.) or at least about 400° F. (204° C.) to having an upper end cut point temperature of about 700° F. (371° C.) or less or 650° F. (343° C.) or less. Optionally, the distillate fuel range can be extended to include additional kerosene, such as by selecting a lower end cut point temperature of at least about 300° F. (149° C.).

In aspects where the inter-stage separator is also used to produce a distillate fuel fraction, the portion boiling below the distillate fuel fraction includes, naphtha boiling range molecules, light ends, and contaminants such as $H_2S$. These different products can be separated from each other in any convenient manner. Similarly, one or more distillate fuel fractions can be formed, if desired, from the distillate boiling range fraction. The portion boiling above the distillate fuel range represents the potential lubricant base stocks. In such aspects, the portion boiling above the distillate fuel range is subjected to further hydroprocessing in a second hydroprocessing stage.

A hydrocracking process under sweet conditions can be performed under conditions similar to those used for a sour hydrocracking process, or the conditions can be different. In an embodiment, the conditions in a sweet hydrocracking stage can have less severe conditions than a hydrocracking process in a sour stage. Suitable hydrocracking conditions for a non-sour stage can include, but are not limited to, conditions similar to a first or sour stage. Suitable hydrocracking conditions can include temperatures of about 500° F. (260° C.) to about 840° F. (449° C.), hydrogen partial pressures of from about 1500 psig to about 5000 psig (10.3 MPag to 34.6 MPag), liquid hourly space velocities of from 0.05 to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 1500 psig to about 3000 psig (10.3 MPag-20.9 MPag), and hydrogen treat gas rates of from about 213 $m^3/m^3$ to about 1068 $m^3/m^3$ (1200 SCF/B to 6000 SCF/B). The LHSV can be from about 0.25 to about 50 or from about 0.5 $h^{-1}$ to about 20 preferably from about 1.0 to about 4.0 $h^{-1}$.

In still another aspect, the same conditions can be used for hydrotreating and hydrocracking beds or stages, such as using hydrotreating conditions for both or using hydrocracking conditions for both. In yet another embodiment, the pressure for the hydrotreating and hydrocracking beds or stages can be the same.

In yet another aspect, a hydroprocessing reaction system may include more than one hydrocracking stage. If multiple hydrocracking stages are present, at least one hydrocracking stage can have effective hydrocracking conditions as described above, including a hydrogen partial pressure of at least about 1500 psig (10.3 MPag). In such an aspect, other hydrocracking processes can be performed under conditions that may include lower hydrogen partial pressures. Suitable hydrocracking conditions for an additional hydrocracking stage can include, but are not limited to, temperatures of about 500° F. (260° C.) to about 840° F. (449° C.), hydrogen partial pressures of from about 250 psig to about 5000 psig (1.8 MPag to 34.6 MPag), liquid hourly space velocities of from 0.05 to 10 and hydrogen treat gas rates of from 35.6 $m^3/m^3$ to 1781 $m^3/m^3$ (200 SCF/B to 10,000 SCF/B). In other embodiments, the conditions for an additional hydrocracking stage can include temperatures in the range of about 600° F. (343° C.) to about 815° F. (435° C.), hydrogen partial pressures of from about 500 psig to about 3000 psig (3.5 MPag-20.9 MPag), and hydrogen treat gas rates of from about 213 $m^3/m^3$ to about 1068 $m^3/m^3$ (1200 SCF/B to 6000 SCF/B). The LHSV can be from about 0.25 $h^{-1}$ to about 50 $h^{-1}$, or from about 0.5 $h^{-1}$ to about 20 $h^{-1}$, and preferably from about 1.0 $h^{-1}$ to about 4.0 $h^{-1}$.

Optional Additional Hydroprocessing—Catalytic Dewaxing and Hydrofinishing

In some alternative aspects, at least a lubricant boiling range portion of the hydroprocessed effluent can be exposed to further hydroprocessing (including catalytic dewaxing) to form lubricant base stocks.

For catalytic dewaxing, suitable dewaxing catalysts can include molecular sieves such as crystalline aluminosilicates (zeolites). In an embodiment, the molecular sieve can comprise, consist essentially of, or be ZSM-12, ZSM-22, ZSM-23, ZSM-48. Optionally but preferably, molecular sieves that are selective for dewaxing by isomerization as opposed to cracking can be used, such as ZSM-48, ZSM-23, or a combination thereof. Additionally or alternately, the molecular sieve can comprise, consist essentially of, or be a 10-member ring 1-D molecular sieve, such as EU-2, EU-11, ZBM-30, ZSM-48, or ZSM-23. ZSM-48 is most preferred. Note that a zeolite having the ZSM-23 structure with a silica to alumina ratio of from about 20:1 to about 40:1 can sometimes be referred to as SSZ-32. Optionally but preferably, the dewaxing catalyst can include a binder for the molecular sieve, such as alumina, titania, silica, silica-alumina, zirconia, or a combination thereof, for example alumina and/or titania or silica and/or zirconia and/or titania.

Preferably, the dewaxing catalysts can be catalysts with a low ratio of silica to alumina. For example, for ZSM-48, the ratio of silica to alumina in the zeolite can be about 100:1 or less, such as about 90:1 or less, or about 75:1 or less, or about 70:1 or less. Additionally or alternately, the ratio of silica to alumina in the ZSM-48 can be at least about 50:1, such as at least about 60:1, or at least about 65:1.

In various embodiments, the dewaxing catalyst can further include a metal hydrogenation component. The metal hydrogenation component is typically a Group VI and/or a Group VIII metal. Preferably, the metal hydrogenation component can be a combination of a non-noble Group VIII metal with a Group VI metal. Suitable combinations can include Ni, Co, or Fe with Mo or W, preferably Ni with Mo or W.

The metal hydrogenation component may be added to the catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

The amount of metal in the catalyst can be at least 0.1 wt % based on catalyst, or at least 0.5 wt %, or at least 1.0 wt %, or at least 2.5 wt %, or at least 5.0 wt %, based on catalyst. The amount of metal in the catalyst can be 20 wt % or less based on catalyst, or 10 wt % or less, or 5 wt % or less, or 2.5 wt % or less, or 1 wt % or less. For embodiments where the metal is a combination of a non-noble Group VIII metal with a Group VI metal, the combined amount of metal can be from 0.5 wt % to 20 wt %, or 1 wt % to 15 wt %, or 2.5 wt % to 10 wt %.

The dewaxing catalysts can also include a binder. In some embodiments, the dewaxing catalysts can be formulated using a low surface area binder, a low surface area binder represents a binder with a surface area of 100 $m^2/g$ or less, or 80 $m^2/g$ or less, or 70 $m^2/g$ or less. Additionally or alternately, the binder can have a surface area of at least about 25 $m^2/g$. The amount of zeolite in a catalyst formulated using a binder can be from about 30 wt % zeolite to 90 wt % zeolite relative to the combined weight of binder and zeolite. Preferably, the amount of zeolite is at least about 50 wt % of the combined weight of zeolite and binder, such as at least about 60 wt % or from about 65 wt % to about 80 wt %.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. The amount of framework alumina in the catalyst may range from 0.1 to 3.33 wt %, or 0.1 to 2.7 wt %, or 0.2 to 2 wt %, or 0.3 to 1 wt %.

Effective conditions for catalytic dewaxing of a feedstock in the presence of a dewaxing catalyst can include a temperature of from 280° C. to 450° C., preferably 343° C. to 435° C., a hydrogen partial pressure of from 3.5 MPag to 34.6 MPag (500 psig to 5000 psig), preferably 4.8 MPag to 20.8 MPag, and a hydrogen circulation rate of from 178 $m^3/m^3$ (1000 SCF/B) to 1781 $m^3/m^3$ (10,000 scf/B), preferably 213 $m^3/m^3$ (1200 SCF/B) to 1068 $m^3/m^3$ (6000 SCF/B). The LHSV can be from about 0.2 $h^{-1}$ to about 10 $h^{-1}$, such as from about 0.5 $h^{-1}$ to about 5 $h^{-1}$ and/or from about 1 $h^{-1}$ to about 4 $h^{-1}$.

Before and/or after catalytic dewaxing, the hydroprocessed effluent can optionally be exposed to an aromatic saturation catalyst, which can alternatively be referred to as a hydrofinishing catalyst. Exposure to the aromatic saturation catalyst can occur either before or after fractionation. If aromatic saturation occurs after fractionation, the aromatic saturation can be performed on one or more portions of the fractionated product. Alternatively, the entire effluent from the last hydrocracking or dewaxing process can be hydrofinished and/or undergo aromatic saturation.

Hydrofinishing and/or aromatic saturation catalysts can include catalysts containing Group VI metals, Group VIII metals, and mixtures thereof. In an embodiment, preferred metals include at least one metal sulfide having a strong hydrogenation function. In another embodiment, the hydrofinishing catalyst can include a Group VIII noble metal, such as Pt, Pd, or a combination thereof. The mixture of metals may also be present as bulk metal catalysts wherein the amount of metal is about 30 wt. % or greater based on catalyst. For supported hydrotreating catalysts, suitable metal oxide supports include low acidic oxides such as silica, alumina, silica-aluminas or titania, preferably alumina. The preferred hydrofinishing catalysts for aromatic saturation will comprise at least one metal having relatively strong hydrogenation function on a porous support. Typical support materials include amorphous or crystalline oxide materials such as alumina, silica, and silica-alumina. The support materials may also be modified, such as by halogenation, or in particular fluorination. The metal content of the catalyst is often as high as about 20 weight percent for non-noble metals. In an embodiment, a preferred hydrofinishing catalyst can include a crystalline material belonging to the M41S class or family of catalysts. The M41S family of catalysts are mesoporous materials having high silica content. Examples include MCM-41, MCM-48 and MCM-50. A preferred member of this class is MCM-41.

Hydrofinishing conditions can include temperatures from about 125° C. to about 425° C., preferably about 180° C. to about 280° C., a hydrogen partial pressure from about 500 psig (3.4 MPa) to about 3000 psig (20.7 MPa), preferably about 1500 psig (10.3 MPa) to about 2500 psig (17.2 MPa), and liquid hourly space velocity from about 0.1 $hr^{-1}$ to about 5 $hr^{-1}$ LHSV, preferably about 0.5 $hr^{-1}$ to about 1.5 $hr^{-1}$. Additionally, a hydrogen treat gas rate of from 35.6 $m^3/m^3$ to 1781 $m^3/m^3$ (200 SCF/B to 10,000 SCF/B) can be used.

Lubricant Base Oil Products

After coking, hydroprocessing, and optional dewaxing/aromatic saturation of a combined coker and used lubricant oil feed, the resulting hydroprocessed (and optionally dewaxed) effluent can be separated to form one or more products. Optionally, a first separation can be performed on the effluent to remove light ends and gas phase contaminants, such as $H_2S$ and $NH_3$ generated during the conversion and hydrotreatment processes. The effluent can then be fractionated using one or more separation or fractionation stages to form at least one lubricant product. The at least one lubricant product can correspond to one or more lubricant base oil products having different viscosities. For example, the fractionation can be used to form one or more of a light neutral lubricant base oil product, such as a product with a viscosity of 3 cSt to 6 cSt @ 100° C.; a heavy neutral base oil product, such as a product with a viscosity of 6 cSt to 15 cSt @ 100° C., for example a base oil product with a viscosity greater than 8 cSt @ 100° C. and/or 12 cSt or less @ 100° C.; and a brightstock product, such as a product with a viscosity of 15 cSt to 50 cSt @ 100° C. Other choices for selecting viscosities for a plurality of lubricant base oil products can also be used. Optionally, the fractionation can also result in production of one or more distillate fuel (diesel or kerosene) boiling range products and/or one or more naphtha boiling range products. In various aspects, the lubricant product(s) can have a pour point of 0° C. or less, or −10° C. or less, or −15° C. or less, such as down to −30° C. or possibly still lower. In some aspects, the lubricant product(s) can have a viscosity index of 80 or more, or 90 or more, or 100 or more, or 120 or more, such as up to about 150 or possibly still higher.

EXAMPLE 1

Marginal Yields from Fluidized Coking of Used Lubricant Oil

Processing of a feedstock including conventional coker feed and used lubricant oil was modeled using an empirical model based on laboratory scale, pilot scale, and commercial scale data. For comparison, processing of a feedstock including only the conventional coker feed was also modeled.

In the modeling comparison, one feedstock included 96 wt % of a fluidized coker feed (a vacuum resid) and 4 wt % of a used lubricant base oil. The modeled feed corresponded to 288 tons/hr of the coker feed and 12 tons/hour of used lubricant oil. Another feedstock included only the 288 tons/hr of the coker feed (the vacuum resid).

Table 1 shows the model product slates generated by modeling the processing of the feeds under the same fluidized coking conditions. In Table 1, the model results for processing of just the vacuum resid resulted in generation of 124 tons/hr of gas oil, which could potentially be further processed to form lubricant base stock. The model results in Table 1 show that based on inclusion of 12 tons/hr of used lubricant oil, an additional 11 tons/hr of gas oil was generated. This corresponds to a marginal yield of gas oil based on used lubricant oil of 86 wt %.

TABLE 1

Model Yields from Fluidized Coking

| Products (tons/hr) | Coker Feed | Coker Feed + Used Oil | Marginal Yield |
|---|---|---|---|
| LPG | 26 | 26 | 1% |
| Naphtha | 46 | 47 | 5% |
| Gasoil | 124 | 135 | 86% |
| Coke | 89 | 90 | 2% |
| Water | | 1 | 7% |

EXAMPLE 2

Marginal Yields from Hydroprocessing to Form Lubricant Oils

The model gas oil products from Table 1 were used in the empirical model as the input for a mild hydrotreating process. Based on the model, the model gas oil products both generated an 80 wt % yield of 370° C.+ hydrotreated gas oil and a 20 wt % yield of distillate fuel boiling range products. Thus, for the hydrotreating step, the marginal yield for the gas oil containing used lubricating oil was the same as the overall yield for the gas oil.

The model hydrotreated gas oil products were then used as input feeds for modeling of a hydrocracking process for formation of lubricant base stocks. One feed corresponded to 49 tons/hr of the hydrotreated gas oil formed from the coker feed, plus 366 tons/hr of a conventional feed for formation of lubricant base stocks. The second feed corresponded to the 49 tons/hr of the conventional hydrotreated gas oil and 357 tons/hr of the conventional feed for forming lubricant base stocks, plus 8.5 tons/hr of gas oil based on the used lubricant oil portion of the feed. The gas oil based on the used lubricant oil had a viscosity index of 110. This represents an increase in the amount of used lubricant oil that would be present in the gas oil, in comparison with the 4 wt % used as the feed to the fluidized coking process. This larger ratio of gas oil derived from the used lubricant oil was selected to assist with determining marginal yields.

Table 2 shows the product slates resulting from the modeling of hydrocracking of the two gas oil feeds. For the gas oil based on the coker feed, the yield of light lube product plus heavy lube product was roughly 30 wt %. By contrast, the isolated used oil yield (i.e., marginal yield) of light lube product plus heavy lube product for the gas oil derived from the used lubricant oil was over 90 wt %. It is noted that the marginal yield calculation as defined herein would normally require a comparison based on keeping the non-used lubricating oil feed components constant. Thus, the Isolated Used Oil Yield column in Table 2 includes an asterisk. However, it is believed that the results in Table 2 are representative of the marginal yields as defined herein. It is noted that the intermediate distillate corresponds to products with a boiling range of roughly 345° C. to 370° C. that are not incorporated into the diesel product or the light lube product.

TABLE 2

Model Yields from Hydrocracking

| Products (tons/hr) | Coker Feed | Coker Feed + Used Oil | Isolated Used Oil Yield* |
|---|---|---|---|
| Naphtha | 34 | 34 | 0 |
| Diesel | 242 | 237 | 6% |
| Intermediate Distillate | 10 | 10 | 0 |
| Light Lube | 69 | 76 | 94% |
| Heavy Lube | 53 | 52 | 0 |

With regard to the heavy lube yields in Table 2, the decrease in heavy lube yield was due to the reduction in the conventional lubricant feed, and is not believed to be due to the inclusion of the used lubricant oil.

EXAMPLE 3

Nitrogen Reduction During Hydroprocessing

Table 3 shows an example of measured nitrogen contents in a heavy coker gas oil (HKGO) generated by fluidized coking of a conventional coker feedstock. The breakdown of the nitrogen content between the 538° C.+ portion and the 538° C.− portions of the heavy coker gas oil is also shown.

TABLE 3

Nitrogen Content in Heavy Coker Gas Oil

| | Nitrogen (wppm) | % HKGO |
|---|---|---|
| Full HKGO | 5853 | 100 |
| 538° C.+ | 5414 | 20 |
| 538° C.− | 5963 | 80 |

As shown in Table 3, the 538° C.− portion of the heavy coker gas oil has a higher nitrogen content than the 538° C.+ portion. Used lubricant oil can typically correspond to a 538° C.− fraction that has a nitrogen content of 100 wppm or less, such as 10 wppm or less, or 2 wppm or less. Thus, the boiling range of the used lubricant fraction is similar to the boiling range of the higher nitrogen content portion of the heavy coker gas oil.

Because the used lubricant oil has a nitrogen content that is effectively 0 in comparison with the heavy coker gas oil, the weight percentage of used lubricant oil added to the coker feed can cause a corresponding weight percentage reduction in the nitrogen content of the 538° C.– portion of the resulting heavy coker gas oil. In other words, adding roughly 10 wt % used lubricant base oil to the feed for fluidized coking can result in a roughly 10% reduction in the nitrogen content (by weight) of the 538° C.– portion of the heavy coker gas oil.

For a feedstock for hydrocracking with a nitrogen content of 2000 wppm or more, or 5000 wppm or more, a 10% reduction in the nitrogen content (by weight) can correspond to roughly a 10° C. reduction in the operating temperature of the hydrocracker. This can extend the cycle length of a hydrocracking reactor by several months.

Additional Embodiments

Embodiment 1. A method for producing a lubricant base oil product, comprising: exposing, in a reactor, a feed comprising: a) 0.5 wt % to 40 wt % of a used lubricant oil comprising a viscosity index of 70 or more, and b) a coker feedstock comprising a T10 distillation point of 450° C. or more, to a fluidized bed comprising solid particles under fluidized coking reactor conditions including a temperature of 510° C. or more (optionally 510° C. to 593° C., or 510° C. to 566° C., or 510° C. to 538° C.) to form a coker effluent, the fluidized coking conditions comprising 10 wt % or more conversion of the feedstock relative to 450° C., the fluidized coking conditions being effective for depositing coke on the solid particles; passing at least a portion of the solid particles comprising deposited coke from the reactor to the coke combustion stage; removing from the coke combustion stage a first portion of the partially combusted solid particles, a rate of removal of the partially combusted solid particles comprising 1.5% or more on a weight basis of a rate of introduction of the feed into the reactor; separating at least a coker gas oil product from the coker effluent; hydroprocessing at least a portion of the separated coker gas oil product under effective hydroprocessing conditions to produce a hydroprocessed coker gas oil having a sulfur content of 100 wppm or less.

Embodiment 2. The method of Embodiment 1, wherein the feed comprises 40 wt % or more of the coker feedstock; or wherein the feed comprises a bio-derived component; or a combination thereof.

Embodiment 3. The method of any of the above embodiments, wherein the coker feedstock comprises a Conradson carbon residue of 5.0 wt % or more, or 7.0 wt % or more; or wherein the feed comprises a Conradson carbon residue of 5.0 wt % or more; or a combination thereof.

Embodiment 4. The method of any of the above embodiments, i) wherein the used lubricant oil comprises a total acid number of greater than 1.0 mg KOH/g oil; ii) wherein the used lubricant oil comprises 10 wppm or more of corrosion metals; iii) wherein the used lubricant oil comprises 100 wppm or more of detergent metals; iv) wherein the used lubricant oil comprises 500 wppm or more of water; v) wherein the used lubricant oil comprises 1.0 wt % or more of additives having a boiling point greater than 1050° F. (~566° C.); vi) a combination of a two or more of i)-v); or vii) all of i)-v).

Embodiment 5. The method of Embodiment 4, wherein the method further comprises exposing the at least a portion of the solid particles comprising deposited coke to combustion conditions to form a gas phase product and partially combusted solid particles, the first portion of the partially combusted coke particles comprising 95 wt % or more of the corrosion metals, or 95 wt % or more of the detergent metals, or a combination thereof, the method optionally further comprising passing at least a second portion of the partially combusted solid particles from the coke combustion stage to the reactor.

Embodiment 6. The method of any of the above embodiments, wherein the used lubricant oil comprises a pre-treated used lubricant oil.

Embodiment 7. The method of any of the above embodiments, wherein the used lubricant oil comprises a viscosity index of 120 or more; or wherein the used lubricant oil comprises a used base oil, the used base oil comprising a viscosity index of 80 or more; or wherein the used lubricant oil comprises a kinematic viscosity at 100° C. of 2.0 cSt to 40 cSt; or a combination thereof.

Embodiment 8. The method of any of the above embodiments, wherein the hydroprocessed coker gas oil comprises a first coker gas oil viscosity index of 75 or more and a kinematic viscosity at 100° C. of 2.0 cSt or more; or wherein the hydroprocessed coker gas oil comprises a lubricant base oil, the lubricant base oil comprising a first base oil viscosity index of to 75 or more and a kinematic viscosity at 100° C. of 2.0 cSt or more; or a combination thereof, wherein optionally the separated coker gas oil product comprises a nitrogen content of 1000 wppm or more and the hydroprocessed coker gas oil comprises a nitrogen content of 100 wppm or less.

Embodiment 9. The method of Embodiment 8, the method further comprising: exposing a second feed to the fluidized bed comprising solid particles under fluidized coking conditions to form a second coker effluent, the second feed comprising less than 0.1 wt % of a used lubricant oil; hydroprocessing at least a portion of the second coker effluent to form a second hydroprocessed coker gas oil wherein a) the second hydroprocessed coker gas oil comprises a second coker gas oil viscosity index that is lower than the first coker gas oil viscosity index by 10 or more; b) wherein the second hydroprocessed coker gas oil comprises a second lubricant base stock, the second lubricant base stock comprising a second base stock viscosity index that is lower than the first base stock viscosity index by 10 or more; or c) a combination thereof.

Embodiment 10. The method of Embodiment 8 or 9, the method further comprising: exposing a third feed to the fluidized bed comprising solid particles under fluidized coking conditions to form a third coker effluent, the second feed comprising 0.5 wt % to 15 wt % of a second used lubricant oil comprising a viscosity index of 70 or more and a transition metal content of 100 wppm or more; hydroprocessing at least a portion of the third coker effluent to form a third lubricant base oil.

Embodiment 11. The method of any of the above embodiments, wherein a marginal yield of lubricant base oil from the used lubricant oil is 40 wt % or more relative to the weight of used lubricant oil in the feed.

Embodiment 12. The hydroprocessed coker gas oil or the lubricant base stock of Embodiment 8, the lubricant base stock optionally comprising a Group II base stock or a Group III base oil.

Embodiment 13. An integrated system for producing lubricant oils from a coker effluent, comprising: a fluidized bed coker comprising one or more coker feed inlets, a cold particle outlet, at least one hot particle inlet, and a coker product outlet; a coke combustion reactor comprising: a coke combustion inlet in fluid communication with the cold particle outlet, a coke combustion outlet in fluid communication with the at least one hot particle inlet via at least one hot particle conduit, at least one coke combustion gas inlet, a particle purge outlet, and a fuel gas outlet; a first separation stage comprising a first separation stage inlet in fluid communication with the coker product outlet, a first separation stage heavy product outlet and a first separation stage light product outlet; one or more hydroprocessing stages comprising a hydroprocessing inlet in fluid to communication with the first separation stage heavy product outlet and a hydroprocessing outlet.

Embodiment 14. The system of Embodiment 13, wherein the fluidized bed coker comprises a scrubbing zone, a coking zone, and a stripping zone, wherein at least one of the one or more coker feed inlets is in fluid communication with the scrubbing zone.

Embodiment 15. The system of Embodiment 13 or 14, wherein the at least one hot coke inlet is in fluid communication with a coking zone of the reactor, or wherein the at least one hot coke inlet is in fluid communication with a stripping zone of the reactor, or a combination thereof.

Supplemental Embodiments

Embodiment A. The system of any of Embodiments 13 to 15, wherein the coke combustion reactor comprises a gasifier, the at least one coke combustion gas inlet comprising at least one gasifier gas inlet.

Embodiment B. The system of any of Embodiments 13 to 15, wherein the system further comprises a heater, the coke combustion inlet being in fluid communication with the cold particle outlet via the heater.

Embodiment C. The method of any of Embodiments 1 to 15, wherein at least a portion of the coker feedstock is introduced into a coking zone of the reactor, or wherein at least a portion of the used lubricant oil is introduced into a scrubbing zone of the reactor, or a combination thereof.

Embodiment D. The method of any of Embodiments 1 to 11, wherein the solid particles comprise coke particles.

Embodiment E. The method of any of Embodiments 1 to 11, wherein hydroprocessing at least a portion of the separated coker gas oil product under effective hydroprocessing conditions comprises hydroprocessing a vacuum gas oil fraction and the at least a portion of the separated coker gas oil product.

Embodiment F. The method of any of Embodiments 1 to 11, wherein the hydroprocessing comprises hydrotreating, hydrocracking or a combination thereof, the hydroprocessing optionally further comprising catalytic dewaxing, aromatic saturation, or a combination thereof.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope to of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

The invention claimed is:

1. A method for producing a lubricant base oil product, comprising:

introducing a first feed via a first line to a scrubbing zone of a reactor to form a scrubbed first feed, the first feed comprising a used lubricant oil comprising a viscosity index of 70 or more;

introducing a second feed via a second line to the scrubbing zone of the reactor to form a scrubbed second feed, the second feed comprising a coker feedstock comprising a T10 distillation point of 450° C. or more, exposing the scrubbed first feed and the scrubbed second feed to a fluidized bed in a coking zone of the reactor at a residence time of about 1 second to about 30 seconds, the fluidized bed comprising solid particles under fluidized coking reactor conditions including a temperature of at least 510° C. to form a coker effluent, the fluidized coking conditions comprising 10 wt % or more conversion of the feedstock relative to 450° C., the fluidized coking conditions being effective for depositing coke on the solid particles;

passing at least a portion of the solid particles comprising deposited coke from the reactor to a coke combustion stage;

removing from the coke combustion stage a first portion of partially combusted solid particles, a rate of removal of the partially combusted solid particles comprising 1.5% or more on a weight basis of a rate of introduction of the feed into the reactor;

separating at least a coker gas oil product from the coker effluent; and hydroprocessing at least a portion of the separated coker gas oil product under effective hydroprocessing conditions to produce a hydroprocessed coker gas oil having a sulfur content of 100 wppm or less.

2. The method of claim 1, wherein the used lubricant oil comprises a total acid number of greater than 1.0 mg KOH/g oil.

3. The method of claim 1, wherein the fluidized coking reactor conditions comprise a temperature of 510° C. to 593° C.

4. The method of claim 1, wherein the used lubricant oil comprises 10 wppm or more of corrosion metals; or wherein the used lubricant oil comprises 100 wppm or more of detergent metals; or a combination thereof.

5. The method of claim 4, wherein the method further comprises exposing the at least a portion of the solid particles comprising deposited coke to combustion conditions to form a gas phase product and partially combusted solid particles, the first portion of the partially combusted coke particles comprising 95 wt % or more of the corrosion metals, or 95 wt % or more of the detergent metals, or a combination thereof.

6. The method of claim 1, further comprising passing at least a second portion of the partially combusted solid particles from the coke combustion stage to the reactor.

7. The method of claim 1, wherein the used lubricant oil comprises 500 wppm or more of water.

8. The method of claim 1, wherein the used lubricant oil comprises a pre-treated used lubricant oil.

9. The method of claim 1, wherein the used lubricant oil comprises a viscosity index of 120 or more; or wherein the used lubricant oil comprises a used base oil, the used base oil comprising a viscosity index of 80 or more; or a combination thereof.

10. The method of claim 1, wherein the used lubricant oil comprises 1.0 wt % or more of additives having a boiling point greater than 1050° F. (about, 566° C.).

11. The method of claim 1, wherein the used lubricant oil comprises a kinematic viscosity at 100° C. of 2.0 cSt to 40 cSt.

12. The method of claim 1, wherein the solid particles comprise coke particles.

13. The method of claim 1, wherein hydroprocessing at least a portion of the separated coker gas oil product under effective hydroprocessing conditions comprises hydroprocessing a vacuum gas oil fraction and the at least a portion of the separated coker gas oil product.

14. The method of claim 1, wherein the hydroprocessed coker gas oil comprises a first coker gas oil viscosity index of 75 or more and a kinematic viscosity at 100° C. of 2.0 cSt or more; or wherein the hydroprocessed coker gas oil comprises a lubricant base oil, the lubricant base oil comprising a first base oil viscosity index of 75 or more and a kinematic viscosity at 100° C. of 2.0 cSt or more; or a combination thereof.

15. The method of claim 14, wherein a marginal yield of lubricant base oil from the used lubricant oil is 40 wt % or more relative to the weight of used lubricant oil in the feed.

16. The method of claim 14, the method further comprising:

exposing a third feed to the fluidized bed comprising solid particles under fluidized coking conditions to form a second coker effluent, the third feed comprising less than 0.1 wt % of a used lubricant oil;

hydroprocessing at least a portion of the second coker effluent to form a second hydroprocessed coker gas oil wherein a) the second hydroprocessed coker gas oil comprises a second coker gas oil viscosity index that is lower than the first coker gas oil viscosity index by 10 or more; b) wherein the second hydroprocessed coker gas oil comprises a second lubricant base oil, the second lubricant base stock comprising a second base oil viscosity index that is lower than the first base oil viscosity index by 10 or more; or c) a combination thereof.

17. The method of claim 16, the method further comprising:

exposing a fourth feed to the fluidized bed comprising solid particles under fluidized coking conditions to form a third coker effluent, the fourth feed comprising 0.5 wt % to 15 wt % of a second used lubricant oil comprising a viscosity index of 70 or more and a transition metal content of 100 wppm or more; and hydroprocessing at least a portion of the third coker effluent to form a third lubricant base oil.

18. The method of claim 14, wherein the separated coker gas oil product comprises a nitrogen content of 1000 wppm or more, and wherein the hydroprocessed coker gas oil comprises a nitrogen content of 100 wppm or less.

19. The method of claim 1, further comprising removing a liquid product from the scrubbing zone of the reactor and introducing the liquid product to the second line to mix the liquid product with the second feed.

20. The method of claim 1, wherein the scrubbing zone is disposed above the coking zone of the reactor.

21. The method of claim 1, wherein the scrubbing zone comprises a plurality of sheds.

* * * * *